US008810466B2

(12) United States Patent
Sciré-Scappuzzo et al.

(10) Patent No.: US 8,810,466 B2
(45) Date of Patent: Aug. 19, 2014

(54) METHOD AND APPARATUS FOR A HIGH-PERFORMANCE COMPACT VOLUMETRIC ANTENNA

(75) Inventors: Francesca Sciré-Scappuzzo, Lexington, MA (US); Sergey N. Makarov, Holden, MA (US)

(73) Assignee: Physical Sciences, Inc., Andover, MA (US)

( * ) Notice: Subject to any disclaimer, the term of this patent is extended or adjusted under 35 U.S.C. 154(b) by 974 days.

(21) Appl. No.: 12/501,973

(22) Filed: Jul. 13, 2009

(65) Prior Publication Data

US 2011/0006957 A1 Jan. 13, 2011

(51) Int. Cl.
*H01Q 9/16* (2006.01)
*H01Q 1/28* (2006.01)
*H01Q 21/12* (2006.01)

(52) U.S. Cl.
USPC ..... 343/802; 343/705; 343/793; 343/813

(58) Field of Classification Search
USPC ..... 343/802
See application file for complete search history.

(56) References Cited

U.S. PATENT DOCUMENTS 3,805,269 A * 4/1974 Fujimoto et al. ..... 343/794

OTHER PUBLICATIONS

"Basic Array Theory," Wolfgang Kummer, Proceedings of the IEEE, vol. 80, No. 1, pp. 127-140, Jan. 1992.*

Balanis, Constantine A., *Antenna Theory Analysis and Design*, (John Wiley & Sons, Inc., 1982, Second Edition), Chapter 4, (73 pages).

Baum, et al., *Ultra-Wideband, Short-Pulse Electromagnetics 8*, (Springer, 2007, First Edition), pp. 57-68.

Best, et al., "A Comparison of Electrically Small HF Antenna," *Antennas and Propagation Society International Symposium*, (2005) (2005 IEEE) vol. 1B, pp. 37-40.

Arun K. Bhattacharyya, "Active Element Pattern Symmetry for Asymmetrical Element Arrays," *Antennas and Propagation Society International Symposium*, (2007) (2007 IEEE), vol. 6, pp. 275-278.

Bailey, et al., "History and Applications of HAARP Technologies: The High Frequency Active Auroral Research Program," *Energy Conversion Engineering Conference*, 1997. *IECEC-91., Proceeding of the 32nd Intersociety*, (1997 IEEE), vol. 2, pp. 1317-1322.

Nhi Ning Chen, *Antennas for Portable Devices*, (Wiley, 2007), Chapter 7, (29 pages).

R. C. Hansen, "Array Elements", *Phased Array Antennas*, (John Wiley & Sons, Inc., 2005, First Edition), Chapter 5, (13 pages).

Kraus, et al., *Antennas for All Applications* (McGraw-Hill, 2003, Third Edition), Chapter 3, (17 pages).

(Continued)

*Primary Examiner* — Graham Smith
(74) *Attorney, Agent, or Firm* — Proskauer Rose LLP

(57) ABSTRACT

A wide-bandwidth antenna (e.g., a rib-dipole antenna) includes a first pole formed by a first conductive member and/or a second pole formed by a second conductive member. The antenna also includes an antenna feed between the first conductive member and the second conductive member. The antenna also includes at least one electrically conductive element including a surface. A portion of the surface is electrically connected to, and extends from, the first conductive member or the second conductive member. The at least one electrically conductive element is capable of conducting a current that generates a magnetic field. The magnetic field lowers a total reactance of the antenna, thereby resulting in enhanced performance of the antenna and more efficient use of volume.

1 Claim, 18 Drawing Sheets

(56) References Cited

OTHER PUBLICATIONS

Mailloux, *Phased Array Antenna Handbook*, (Artech House Antenna Library, 1993, Second Edition), Chapter 2, (53 pages).
Makarov, et al, "Scan Impedance for an Infinite Dipole Array: Accurate Theoretical Model Compared to Numerical Software," *IEEE Antennas and Propagation Magazine*, vol. 50, No. 6, (2008), (20 pages).
Volakis, J.I., *Antenna Engineering Handbook*, (McGraw-Hill, 2007, Fourth Edition), Chapter 4, (33 pages).
Volakis, J.I., *Antenna Engineering Handbook*, (McGraw-Hill, 2007, Fourth Edition), Chapter 20, (21 pages).
Waldron, et al, "Measurement of Dielectric Permittivity and Loss Tangent for Bulk Foam Samples with Suspended Ring Resonator Method," *Antennas and Propagation Society International Symposium*, (2006 IEEE), (2006) (4 pages).

* cited by examiner

METHOD AND APPARATUS FOR A HIGH-PERFORMANCE COMPACT VOLUMETRIC ANTENNA

STATEMENT OF GOVERNMENT INTEREST

The subject matter described herein was developed in connection with funding provided by the U.S. Army under Small Business Innovation Research (SBIR) Contract No. W15QKN-08-C-0050. The federal government may have certain rights in the technology.

FIELD OF THE INVENTION

This invention relates to antennas, and more specifically to antennas that achieve wide bandwidth, occupy a small volume, and are easily manufactured.

BACKGROUND OF THE INVENTION

A performance of an antenna can be defined in terms of its gain, bandwidth, antenna pattern, pattern control and reactance. A gain of an antenna can be defined as the ratio between a radiation intensity of the antenna in a certain direction and the radiation intensity that would be obtained if the power accepted by the antenna were radiated isotropically. A bandwidth of an antenna can be defined as a range of frequencies, on either side of a center frequency (usually the resonance frequency for a dipole) where the matching antenna characteristics (the input impedance) are within an acceptable value. The antenna fractional bandwidth is the ratio of the bandwidth to its center frequency (percentage). When the bandwidth is larger than 100% it is measured as the ratio of the upper frequency to the lower frequency of the band. For example, the 2:1 antenna has one octave bandwidth. An antenna pattern is a graphical representation of the radiation properties of the antenna as a function of space coordinates. Pattern control is the capability of intentionally modifying the pattern, for instance via antenna geometry manipulation. Reactance is defined as a measure of the opposition of capacitance and inductance to current.

There are two types of reactance: capacitive reactance and inductive reactance. Capacitive reactance is a function inversely proportional to the frequency and the capacitance. Inductive reactance is a function proportional to the frequency and the inductance. Total reactance is a function given by the difference between the inductive reactance and the capacitive reactance.

Antennas in the prior art include dipole antennas, helical antennas, loop antennas, and parabolic antennas. FIG. 1A shows a dipole antenna in the prior art. The dipole antenna can be used in communications. The dipole antenna 100 includes two conductors (e.g., a first pole 110, second pole 120) and an antenna feed 150 (e.g., a center feed element). Electric current flow in the dipole antenna from the feed generates of a first current flow 115 in the first pole 110 of dipole antenna 100, and second current flow 125 in the second pole 120 of dipole antenna 100. A common dipole is the half-wave dipole (e.g., a wire of total length equal to half the wavelength). The theoretical maximum gain of a half-wave dipole is 2.15 dB. The fundamental 10-12% bandwidth of a straight half-wavelength cylindrical dipole antenna is a weak function of the ratio of the length of the dipole to its diameter and the reactance as function of frequency. To fit in the small space available, and to comply with stealth requirements, the dipole antenna has to be reduced in size and become electrically small antennas that do not work at resonance (non-resonant dipole). Dipoles that are designed to be much smaller than the wavelength of operation, have a very low radiation resistance and high capacitive reactance that makes them inefficient. The (matched) bandwidth of small dipoles drastically decreases from 10-12% to 0.1% and less.

FIG. 1B shows a helical antenna 130 according to the prior art. A helical antenna 130 has a conducting wire 131 wound in the form of a helix. Helical antennas 130 can operate in one or two principal modes: normal mode (broadside) or axial mode (end-fire). In the normal mode, the dimensions of the helix are small compared with the wavelength. The far field radiation pattern is similar to an electrically short dipole or monopole. Normal mode helical antennas 130 tend to be inefficient radiators and are typically used for mobile communications where reduced size is a critical factor. Helical antennas 130 possess erratic impedance behavior at low frequencies, especially for short helixes with many turns operating in the normal mode. In the axial mode, the helix dimensions are at or above the wavelength of operation. The helical antenna 130 produces circular polarization. Antenna size makes helical antennas 130 unwieldy for low frequency operation, so they are commonly employed only at frequencies ranging from VHF (e.g., about 30 MHz to about 300 MHz) up to microwaves. The axial mode helical antenna has a very directive antenna beam, not appropriate for communications, where a wide beam is required. The helical antenna has about 3-15% bandwidth.

FIG. 1C shows a loop antenna 140, according to the prior art. The loop antenna 140 is an alternative solution to the optimization of the volume occupied for RF communications. Even though the loop antenna 140 is overall smaller than a whip antenna resonating at the same frequency (e.g., the diameter of the loop is about $\lambda/10$), it is not practical since it can require assembly, has a very narrow bandwidth, and works well only when very close to the ground. The resonant loop has 10-15% bandwidth. The magnetic loop, however, poses serious health risks for the human body when exposed to its concentrated radiated field.

FIG. 1D shows a parabolic antenna 145, according to the prior art. The parabolic dish antenna 145 has a gain that is mainly a function of its diameter 146 and operating frequency. The parabolic antenna has a narrow beam (antenna pattern) and is desirable for applications that require directive antennas and high gain. For instance, approximate gain and a 3 dB beam angle of a 3 meter parabolic dish are 22 dB at 500 MHz with a 3 dB beam angle of 14 degrees, and 28 dB at 1 GHz with a 3 dB beam angle of 7 degrees. The bandwidth of the parabolic dish antenna 145 is equal to the bandwidth of the feeding element (e.g., the horn). The parabolic dish antenna 145 has good gain and wide bandwidth, but is bulky and needs precise mechanical steering for proper pointing.

SUMMARY OF THE INVENTION

The invention features a wide bandwidth, compact volumetric antenna. A volumetric antenna is one that is not planar or linear, but rather, occupies a volume. Advantages of a dipole antenna (e.g., feasible at very long wavelengths) can be retained but with better performance than traditional dipoles (e.g., better matching, wider bandwidth, and occupying a smaller volume). The antenna can occupy a smaller volume to allow miniaturization while achieving wider bandwidth, pattern control, and low manufacturing cost as compared to state-of-the-art antennas. The volume can be more efficiently used than a traditional dipole antenna and can be designed to be shorter than, for example, traditional dipole antennas at the same operating frequency. The wide bandwidth, compact volumetric antenna can be designed to be, for example, up to five times shorter than a conventional HF whip antenna.

Capabilities include a more stable pattern and greater bandwidth than conventional dipole antennas in less than, for example, half the linear dimension. A 3:1 or even 4:1 bandwidth can be achieved for the high-performance compact volumetric antenna with ground plane. Applications for the technology include, for example, RF communications (e.g., on a soldier's manpack, on land vehicles, on UAV's, on munitions for HF, UHF and VHF communications), enhanced performance/safety for cell phones, and high definition digital TV. Moreover, a directive antenna pattern can be obtained using an array of compact volumetric antennas to be used in High Power Microwave systems and platforms (e.g., for Directed Energy applications to produce high-density bursts of energy capable of damaging or destroying nearby electronics). The technology has excellent performance in the HF frequency band (e.g., High Frequency of about 3 MHz to about 30 MHz) and in the VHF frequency band (e.g., about 30 MHz to about 300 MHz), where the large wavelengths (e.g., between about 100 m and about 1 m) require large antenna sizes for classic antennas. Moreover, the high performance compact volumetric antenna can be scaled to work at other frequencies.

In one aspect, the invention features a wide-bandwidth antenna (e.g., a "rib-dipole" antenna) that includes a first pole formed by a first conductive member, a second pole formed by a second conductive member and an antenna feed between the first conductive member and the second conductive member. The antenna also can include at least one electrically conductive element. The electrically conductive element can include a surface having a portion that is electrically connected to the first conductive member or the second conductive member. The electrically conductive element can also extend from the first conductive member or the second conductive member. The at least one electrically conductive element can be capable of conducting a current that generates a magnetic field that lowers a total reactance of the antenna.

At least one electrically conductive element can be attached/connected to (e.g., adjacent) the first conductive member or the second conductive member. In some embodiments, the portion of the surface of at least one electrically conductive element is connected/attached to, and extends laterally from, the first conductive member or the second conductive member. The electrically conductive element can be curvilinear and can include a contoured surface. In some embodiments, a portion of the contoured surface is connected to, and extends laterally from, the first conductive member or the second conductive member. In some embodiments, the antenna is "conformal." The antenna can conform to any shape/surface (e.g., an irregular surface) on a body. By way of example, the antenna can conform to an aircraft wing or a vehicle body.

The first conductive member and the second conductive member can be metal plates/sheets/blades. In some embodiments, the electrically conductive element is a planar electrically conductive element that is connected to, and extends from, the first conductive member or the second conductive member. The planar electrically conductive element can be disposed at an angle (e.g., substantially perpendicular) relative to the first conductive member or the second conductive member.

In some embodiments, the antenna also includes a third pole formed by a third conductive member and a fourth pole formed by a fourth conductive member. The first conductive member, the second conductive member, the third conductive member, the fourth conductive member and the electrically conductive element(s) occupy a volume. The volume can be, for example, a cylindrical volume, a conical volume, a biconical volume, a sphere, a pyramid or a parallelepiped.

The first conductive member can be substantially co-axial to the second conductive member. In some embodiments, the magnetic field generated by the electrically conductive element is substantially parallel to a longitudinal axis of a volume formed by the antenna (e.g., the first conductive member, the second conductive member and electrically conductive element(s)).

The electrically conductive element(s) can be a metal plate or metal sheet. For example, the electrically conductive element can be a closed ring, a hollow cylinder, a strip, a fractal strip, a slotted strip or include any combination/variation thereof.

In some embodiments, the antenna includes a first, second and third electrically conductive element. The electrically conductive elements can be each spaced at a distance relative to one another. The distance can be, for example, constant, linear, increasing, decreasing, logarithmic, randomly distributed, or any combination/variation thereof.

A length of the antenna (e.g., a length of the volume occupied by the antenna) can be greater than a width, thickness, or radial width of the antenna.

In another aspect, the invention features a wide-bandwidth antenna ("rib-dipole"). The antenna can include a first pole formed by a first conductive plate, a second pole formed by a second conductive plate and an antenna feed between the first conductive plate and the second conductive plate. The antenna can also include two or more planar electrically conductive sheets that are electrically connected to, and disposed substantially perpendicular from, or at an angle from, the first conductive plate. The electrically conductive sheets(s) can be capable of conducting a current generating a magnetic field that lowers a total reactance of the antenna.

In another aspect, the invention features a wide-bandwidth antenna ("rib-dipole") that includes a first conductive member, a second conductive member, and an antenna feed between the first conductive member and the second conductive member. The antenna can also include at least two electrically conductive components disposed along the first conductive member or the second conductive member. The electrically conductive components each include respective surfaces each having a portion electrically connected to, and extending from, the first conductive member or the second conductive member. The electrically conductive components are capable of conducting a respective current that generates a respective magnetic field that lowers an overall total reactance of the antenna.

In some embodiments, the electrically conductive components extend laterally from the first conductive member or the second conductive member. The electrically conductive components can be curvilinear and include respective contoured surfaces, each having a portion connected to, and laterally extending from, the first conductive member or the second conductive member. The electrically conductive components can each have different lengths, widths, or thicknesses.

The antenna can include two poles formed by a first metal plate and a second metal plate. The electrically conductive components can be planar electrically conductive sheets connected to, and substantially perpendicular to, the first metal plate and/or the second metal plate. In some embodiments, the antenna is substantially parallel relative to a ground plane.

In some embodiments, the antenna includes a third conductive member and a fourth conductive member. The first conductive member, the second conductive member, the third conductive member, the fourth conductive member and the at least two electrically conductive components can occupy a volume. The volume can be, for example, a cylindrical volume, a conical volume, a bi-conical volume, a sphere, a pyramid, or a parallelepiped.

The electrically conductive components can include a closed ring, a hollow cylinder, a curvilinear strip, a fractal strip, a slotted strip or any combination/variation thereof. The electrically conductive components can be disposed at an angle relative to a shared longitudinal axis of the first conductive member and the second conductive member (e.g., where the first conductive member and the second conductive member are substantially coaxial).

In some embodiments, the antenna also includes a third electrically conductive component and the electrically conductive components are each spaced at a distance relative to one another. The distance can be, by way of example, constant, linear (e.g., linearly increasing or decreasing), increasing, decreasing, logarithmic, randomly distributed or any combination/variation thereof.

In yet another aspect, the invention features a method for transmitting or receiving electromagnetic energy. The method can include the step of providing at least a first current flow in a first pole of an antenna and generating a second current flow in at least one electrically conductive element from the first current flow in the first pole. The at least one electrically conductive element can include a surface having a portion electrically connected to, and extending from, the first pole. The method can also include the step of generating a magnetic field from the second current flow in the at least one electrically conductive element, where the magnetic field lowers an intrinsic reactance of the antenna.

In some embodiments, the at least one electrically conductive element is curvilinear and includes a contoured surface. A portion of the contoured surface can be electrically connected to, and extend laterally from, the first pole. In some embodiments, the electrically conductive element is a planar electrically conductive sheet that is electrically connected to, and substantially perpendicular to, the first pole.

In another aspect, the invention features a wide-bandwidth antenna. The antenna includes a first pole formed by a conductive member and an antenna feed electrically connected to the conductive member. The antenna can also include at least one electrically conductive element configured to conduct a current from the first pole that generates a magnetic field that lowers a total reactance of the antenna. A portion of a surface of the electrically conductive element can be electrically connected to, and extend laterally from, the conductive member.

In some embodiments, the at least one electrically conductive element includes a contoured surface having a portion electrically connected to, and extending laterally from, the conductive member.

The first pole and the antenna feed can form a monopole antenna (e.g., together with the electrically conductive elements forming a "rib-monopole"). In some embodiments, the antenna also includes a second pole formed by a second conductive member. The second conductive member can be substantially coaxial to the conductive member.

In another aspect, the invention features a system for transmitting and receiving electrical signals. The system can include a power source and an antenna. The antenna can include a first conductive member configured to conduct a first current from the power source and an antenna feed electrically coupled to the first conductive member. The system can also include at least one electrically conductive component including a surface having a portion electrically connected to, and extending from, the first conductive member. The electrically conductive component is capable of conducting a second current generated by the first current in the first conductive member and the second current can produce a corresponding magnetic field that lowers a total reactance of the antenna.

In some embodiments, the system also includes a second conductive member configured to conduct a third current from the power source. The second conductive member can be electrically coupled to the antenna feed. The system can also include a second electrically conductive component including a surface having a portion electrically connected to, and extending from, the second conductive member. The second electrically conductive component can be configured to conduct a fourth current generated by the third current. The fourth current can produce a corresponding magnetic field that lowers the total reactance of the antenna.

Other aspects and advantages of the invention can become apparent from the following drawings and description, all of which illustrate the principles of the invention, by way of example only.

BRIEF DESCRIPTION OF THE DRAWINGS

The advantages of the invention described above, together with further advantages, may be better understood by referring to the following description taken in conjunction with the accompanying drawings. The drawings are not necessarily to scale, emphasis instead generally being placed upon illustrating the principles of the invention.

DETAILED DESCRIPTION OF THE INVENTION

Figure 1A:
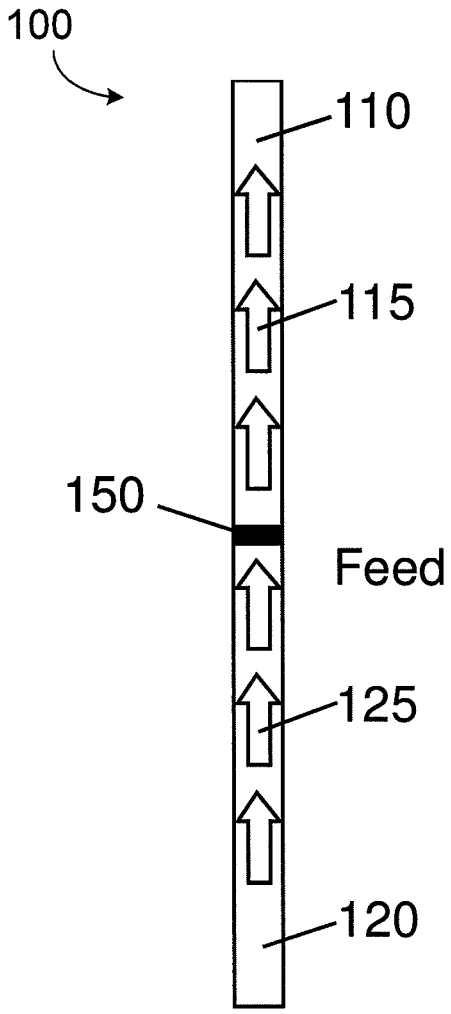
FIG. 1A PRIOR ART
FIG. 1A depicts a dipole antenna in the prior art.
Figure 1B:
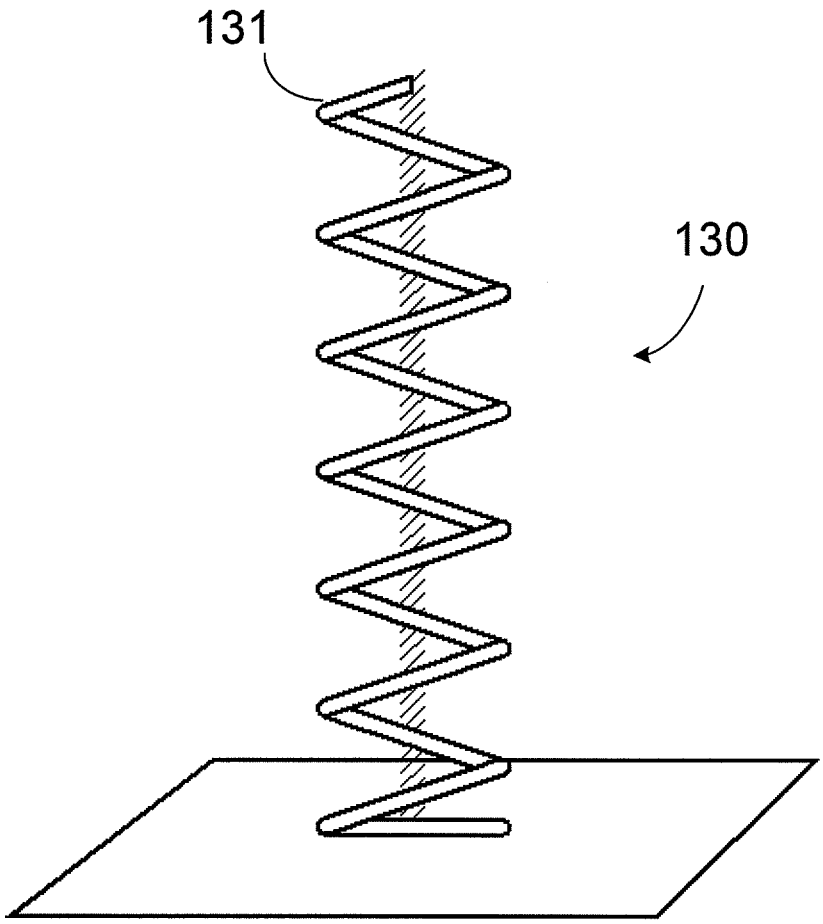
FIG. 1B PRIOR ART
FIG. 1B depicts a helical antenna in the prior art.
Figure 1C:
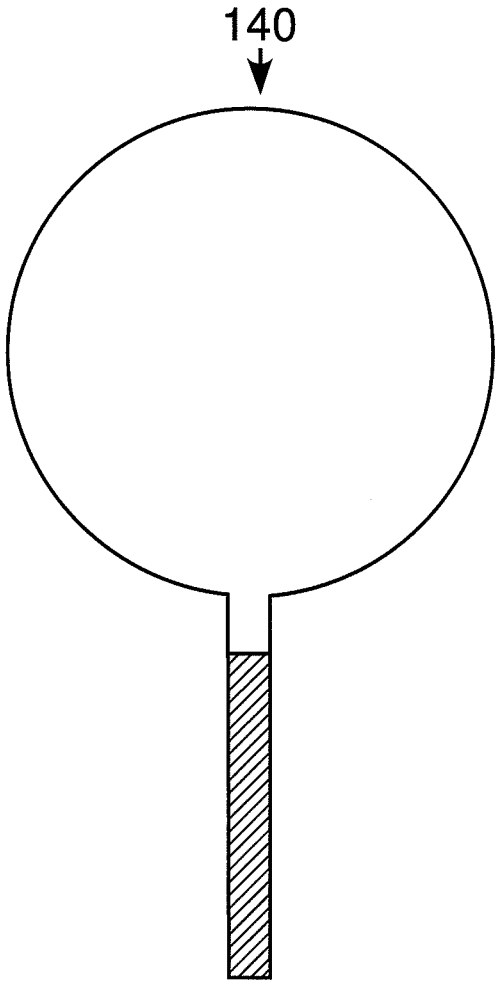
FIG. 1C PRIOR ART
FIG. 1C depicts a loop antenna in the prior art.

A high performance, compact volumetric antenna (e.g., "rib-dipole" or a "rib monopole" antenna) has the advantages of a traditional dipole antenna (e.g., dipole 100 as shown in FIG. 1A), but with higher performance capabilities. Advantages of a rib-dipole/monopole antenna include, for example, a monotonic, predictable and smooth impedance curve. Another advantage is the lack of erratic impedance behavior at low frequencies (e.g., as compared to the helical antenna as shown in FIG. 1B). Therefore, the rib-dipole/monopole antenna is better matched over a wider band as compared to small helical antennas in the prior art. The rib-dipole antenna can have a pattern that can be the same pattern of a traditional dipole antenna, regardless of size. In contrast, the helical antenna changes its pattern from broadside to end-fire when frequency increases. Therefore, the rib-dipole/monopole antenna can be used for both small and intermediate frequencies (e.g., over a wider bandwidth) in contrast to the helical antenna. As with a traditional dipole antenna, the rib-dipole antenna can be a high-impedance load at low frequencies and can also be used as a radiating antenna (e.g., as compared to a small loop antenna as shown in FIG. 1C, which is a low-impedance load that cannot be used as a radiating antenna.)

A traditional dipole antenna (e.g., dipole 100 of FIG. 1A), however, has a large capacitive reactance, $X_C$ that reduces the efficiency of the antenna.

$$X_C = -\frac{1}{\omega C} = -\frac{1}{2\pi f C} \qquad \text{EQN. 1}$$

where f=frequency (hertz, Hz), C=capacitance (farads, F). To improve the performance of traditional dipole antennas, the high capacitive reactance of dipoles can be tuned out introducing a tuning inductor or is reduced adding a top-loading to increase the capacitance.

The enhanced performance of the high performance compact volumetric antenna (e.g., the rib-dipole/monopole antenna) can be attributed to the additional magnetic fields produced by the antenna's specific geometric configuration. The additional magnetic fields are produced from electrically conductive components/element(s) disposed along the pole(s) of the antenna. The electrically conductive component/elements can be curved/curvilinear or straight. The electrically conductive component/elements are attached to the pole(s) of the antenna and can extend from the poles (e.g., laterally extend outwards, like ribs). Layers of an electrically conductive material (e.g., metal layers, such as a copper, brass, gold, carbon fibers, carbon nanotubes, etc.) can be disposed to form the shape of electrically conductive components/elements on to a dielectric cylinder, making the antenna affordable to manufacture, less sensitive to damage and to manufacturing uncertainties. The antenna can conform to any surface/shape of a body (e.g., can conform to an aircraft wing, vehicle body, etc.) These additional magnetic fields produce a desirable inductive reactance that lowers the total reactance of the antenna, which results in higher performance (e.g., wider bandwidth, better matching). The improved performance of the antenna 200 is attributed, at least in part, to its intrinsic large inductive reactance, $X_L$:

$$X_L=\omega L=2\pi f L \qquad \text{EQN. 2}$$

where f=frequency (Hertz, Hz), L=inductance (henrys, H). A large inductive reactance ($X_L$) (e.g., from EQN. 2) can reduce the total reactance (X) of the antenna:

$$X=X_L-X_C \qquad \text{EQN. 3}$$

and where $\overline{Z}_A$ is the antenna impedance:

$$\overline{Z}_A=R+jX \qquad \text{EQN. 4}$$

where R is the antenna radiation resistance and j is the imaginary unit.

EQN. 3 above shows that the lower is the frequency, the higher is $X_C$ and the lower is $X_L$. The smaller the capacitance, the higher is $X_C$. The smaller the inductance, the lower is $X_L$. Therefore, at lower frequencies of the RF spectrum (e.g. HF range), traditional dipole antennas (e.g., of FIG. 1A) have increasing high intrinsic capacitive reactance, a large total reactance, and therefore worse performance than at higher frequencies. The inductive reactance to lower the total reactance (X) can be achieved by introducing electrically conductive component/elements that produce additional magnetic fields that increase the inductive reactance and lower the total reactance of the antenna (e.g., the total reactance can be, for example, 5-8 times smaller than that of a traditional dipole antenna at low frequencies). Similarly, the inductive reactance is larger than the inductive reactance of a traditional dipole antenna.

Figure 2A:
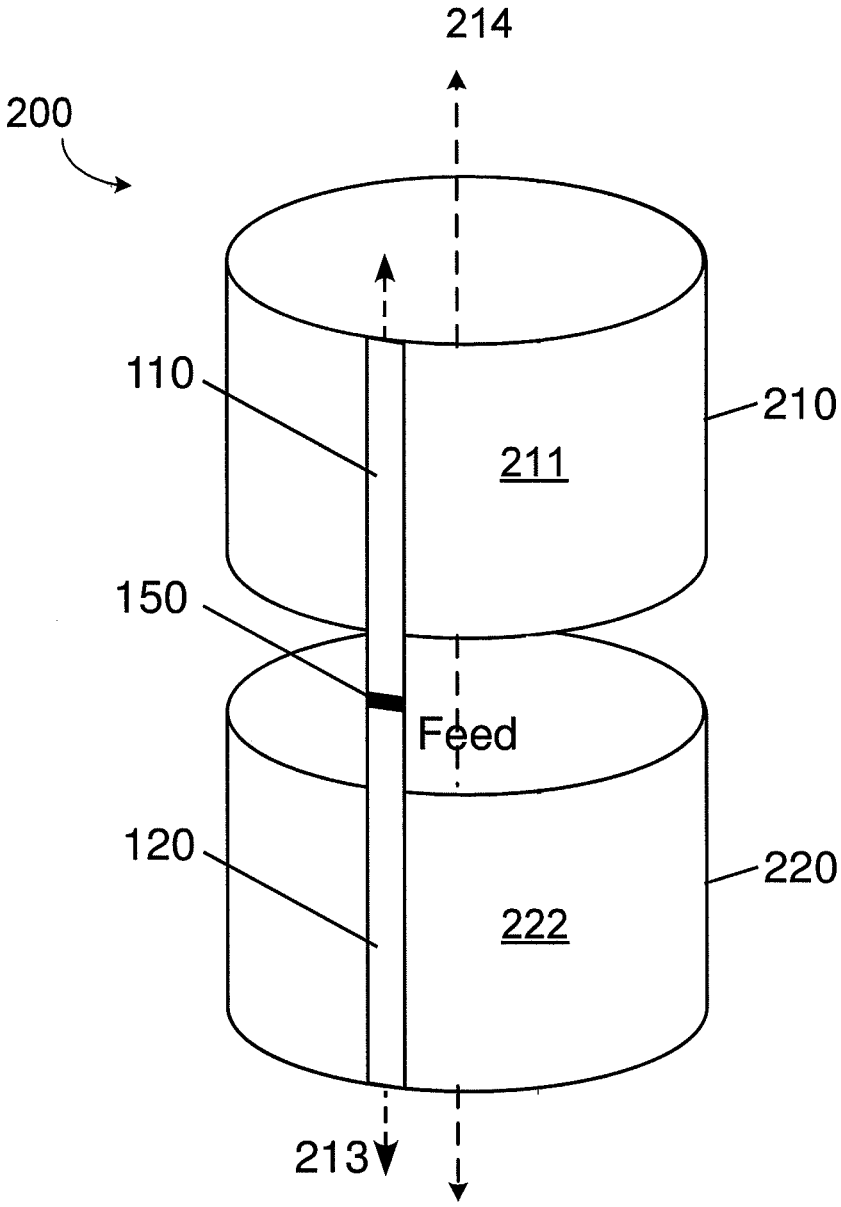
FIG. 2A is a schematic of a high performance volumetric antenna, according to an illustrative embodiment of the invention.

FIG. 2A shows a schematic of a high performance compact volumetric antenna (e.g., a rib-dipole antenna), according to an illustrative embodiment of the invention. The antenna 200 includes a first pole 110, second pole 120, antenna feed 150 and electrically conductive component/elements 210 and 220. Poles 110 and 120 can be formed from conductive members (e.g., a metal member) having the antenna feed 150 between the members. The antenna 200 can include at least one electrically conductive component/element. In this embodiment, the antenna 200 includes a first curvilinear electrically conductive component/element 210 and a second curvilinear electrically conductive component/element 220. As noted above, the electrically conductive component/element 210 and 220 can conduct a current that generates a magnetic field that lowers a total reactance of the antenna 200, thereby resulting in enhanced performance. Accordingly, the antenna 200 has advantages of a traditional dipole antenna but with greater performance (e.g., wide bandwidth), thereby allowing for more efficient use of space.

The electrically conductive component/elements 210 and 220 extend from the first pole 110 and the second pole 120 (e.g., the electrically conductive component/elements do not surround/encompass the first pole 110 and the second pole 120). The electrically conductive component/elements 210 and 220 can extend laterally from the first pole 110 and second pole 120 (e.g., like conductive "ribs" pointing out from and disposed along the poles). In some embodiments, the electrically conductive component/elements 210 and 220 are adjacent poles 110 and 120. Each electrically conductive component/element 210 and 220 can include a surface 211 and 222 (e.g., or a wall). For example, electrically conductive component/element 210 or 220 can be curvilinear and the surface/wall 211 and 222 can be a contoured surface. A portion of the surface/wall 211 and 222 can be connected/attached (e.g., electrically connected) to the first pole 110 and the second pole 120.

The first pole 110 and the second pole 120 can be substantially coaxial and share a common longitudinal axis 213. In some embodiments, the electrically conductive component/elements 210 and 220 form a volume (e.g., a cylindrical volume) having a longitudinal axis 214 that is substantially parallel to the longitudinal axis 213 of the poles 110 and 120. In some embodiments, the magnetic field generated by electrically conductive component/elements 210 and 220 are substantially parallel to the longitudinal axis 214.

Figure 7:
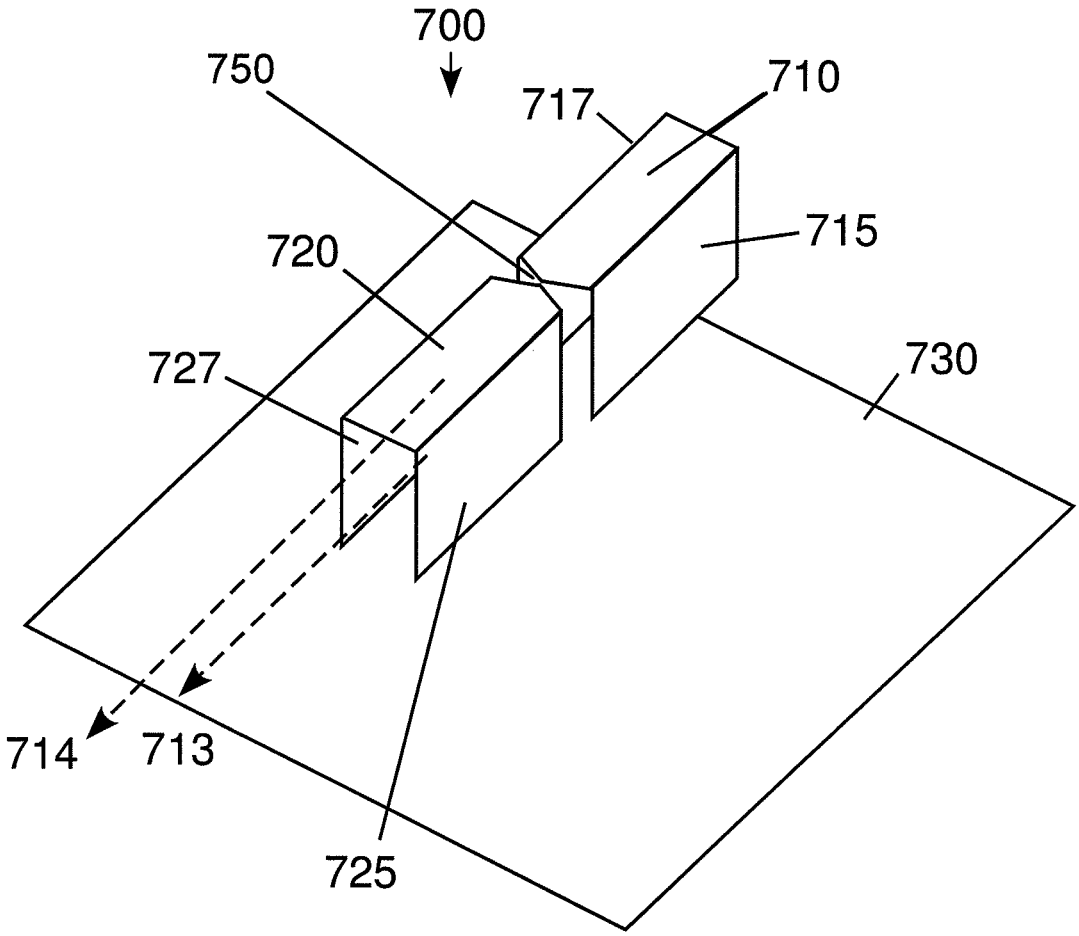
FIG. 7 is a schematic of a compact volumetric antenna over a ground plane, according to an illustrative embodiment of the invention
Figure 13:
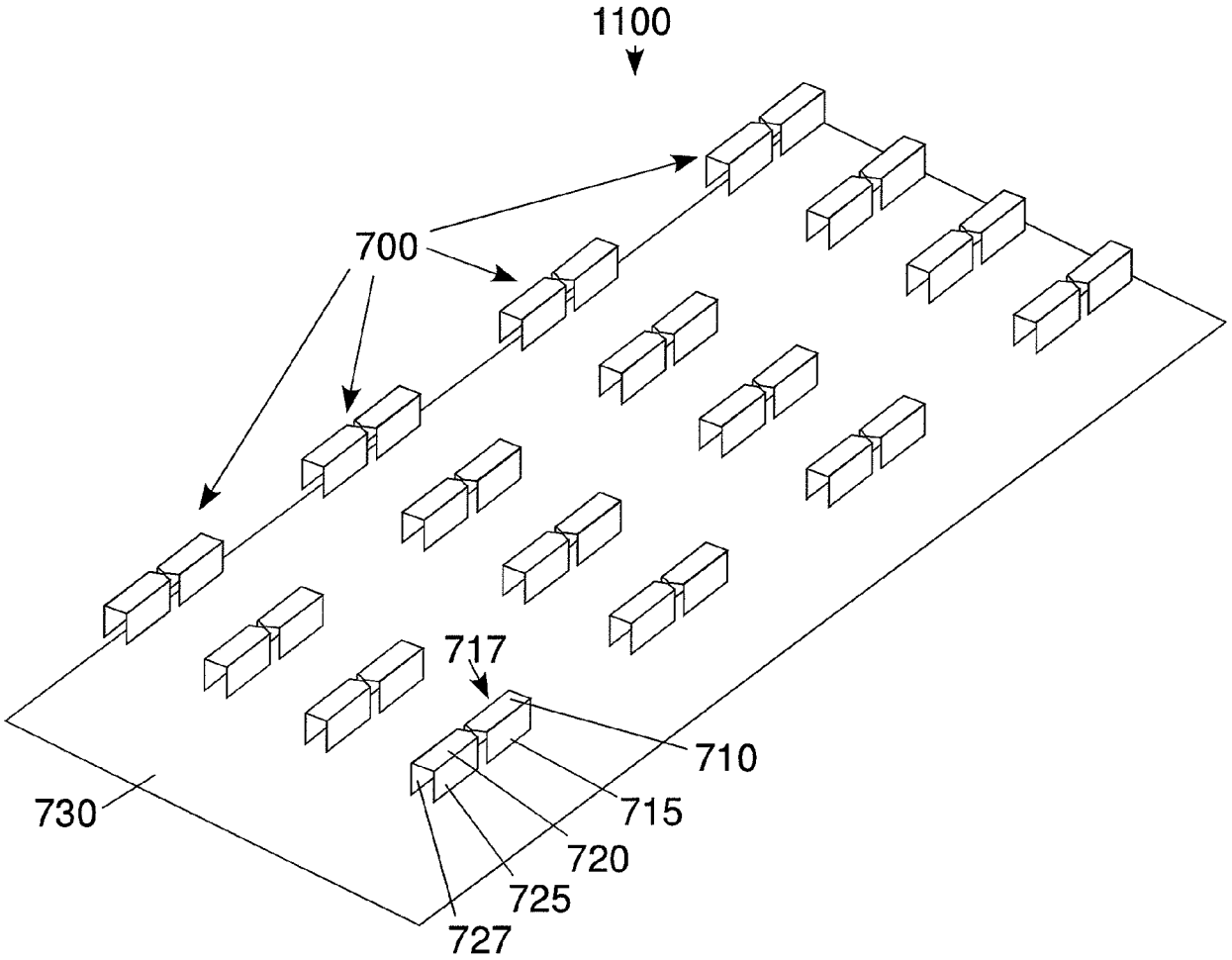
FIG. 13 is a schematic of a volumetric antenna array over a ground plane, according to another illustrative embodiment of the invention.

In this embodiment, the electrically conductive component/elements 210 and 220 are curved (e.g., curve metal sheets/plates that are closed rings). However, in some embodiments, as shown in FIGS. 7 and 13, the electrically conductive components/elements are planar sheets/plates that are disposed along and connected to (e.g., electrically connected and/or attached) the dipole antenna. In this embodiment, the electrically conductive component/elements 210 and 220 are hollow cylinders. However, in other embodiments, the electrically conductive component/elements can be metal plates or metal sheets (e.g., a closed ring, a strip, a fractal strip, a slotted strip, or any combination thereof). Furthermore, in this embodiment, antenna 200 includes two electrically conductive component/elements 210 and 220. However, it is contemplated that an antenna can include any number of electrically conductive component/elements (e.g., one or more). Furthermore, in some embodiments, the electrically conductive component/elements 210 and 200 are disposed at an angle relative to the longitudinal axis 213.

In some embodiments, the antenna 200 is "conformal." The antenna 200 can conform to any shape/surface (e.g., an irregular surface) on a body. By way of example, the antenna can conform to an aircraft wing or a vehicle body.

Figure 2B:
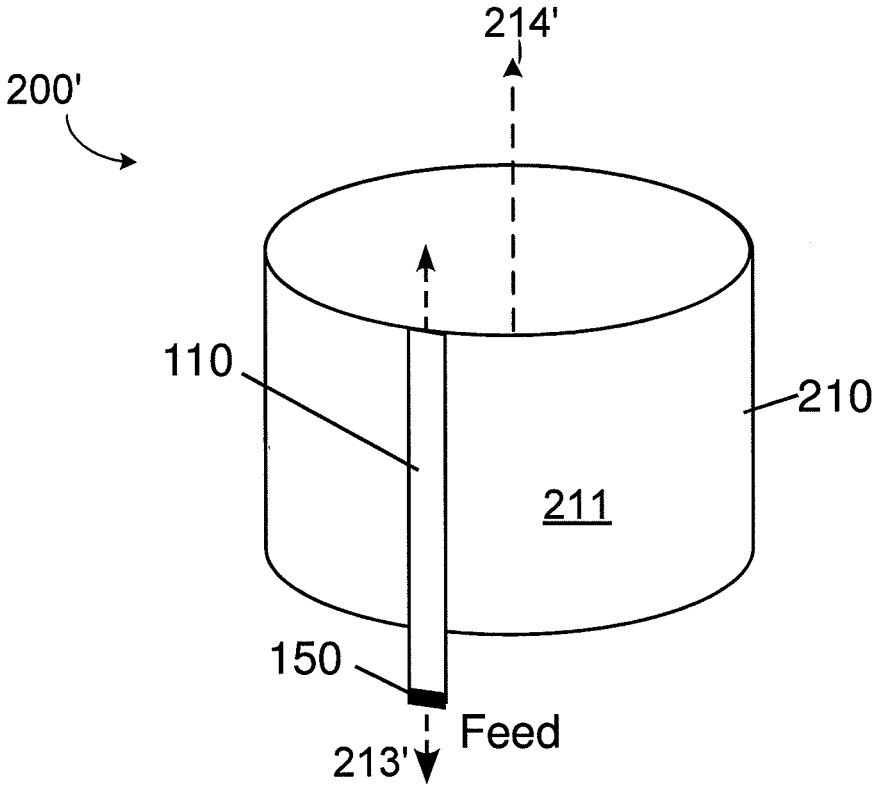
FIG. 2B is a schematic of a high performance volumetric antenna, according to another illustrative embodiment of the invention.

FIG. 2B shows a high performance compact volumetric antenna 200' (e.g., a "rib-monopole"), according to an illustrative embodiment of the invention. In this embodiment, the antenna 200' includes one pole 110 (e.g., "monopole" from a conductive member) and antenna feed 150 electrically coupled to the pole 110. An electrically conductive component/element 210 is attached/connected to pole 110. A portion of a contoured surface/wall 211 of the electrically conductive component/element 210 is attached to pole 110 and also extends from (e.g., laterally extends from the sides, like a "rib") the pole 110. While antenna 200' includes an electrically conductive component/element 210, it is contemplated that an antenna could include any number of electrically conductive component/elements. Antenna 200' can be "conformal" and conform to a body (e.g., aircraft wing, vehicle body, etc.)

In this embodiment, the electrically conductive component/element 210 is a curvilinear electrically conductive component/element (e.g., a closed "ring" or cylinder). As described above, the electrically conductive component/element 210 is capable of conducting a current (e.g., generated by the current in pole 110) that generates a magnetic field that lowers an overall reactance of the antenna 200', thereby providing enhanced performance (e.g., wide bandwidth) in a more compact volume. In this embodiment, the pole 110 can include a longitudinal axis 213' and the antenna (e.g., the pole 110, electrically conductive component/element 210) occupies a volume (e.g., a cylindrical volume) that has a longitudinal axis 214' that is substantially parallel to longitudinal axis 213'.

Figure 3:
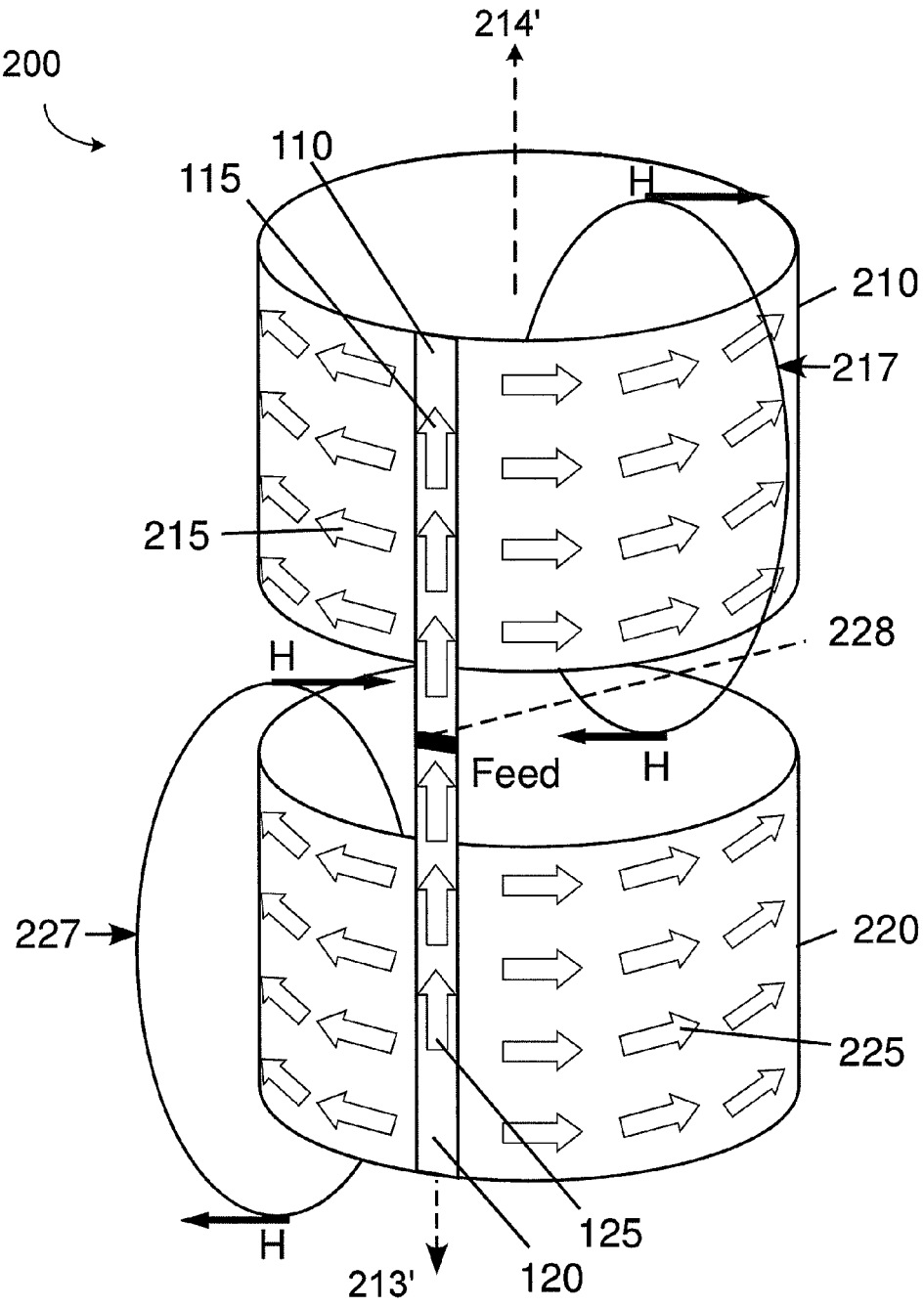
FIG. 3 is a schematic of electric currents and magnetic fields in the antenna of FIG. 2A, according to an illustrative embodiment of the invention.

FIG. 3 is a schematic of electric currents and magnetic fields in antenna 200 of FIG. 2A, according to an illustrative embodiment of the invention. In this embodiment, the first current flow 115 and second current flow 125 generates a current flow 215 in first curvilinear electrically conductive component/element 210 and a current flow 225 in the second curvilinear electrically conductive component/element 220. Associated with the first current flow 215 is a first magnetic field 217 and associated with current flow 225 is a magnetic field 227. The antenna 200 occupies a volume (e.g., cylindrical volume) having a longitudinal axis 214. The magnetic field 217 and 227 can be substantially parallel to the longitudinal axis 214.

A power source 228 can supply power to generate a current 115 and 125 in the poles 110 and 120, which subsequently generates a current 215 and 225 in the electrically conductive component/elements 210 and 220. A method for transmitting or receiving electromagnetic energy can include the step of providing/conducting at least a first current flow 115 in a first pole 110 (e.g., from the power source 228) of an antenna and generating a second current flow 215 in at least one electrically conductive element 210 from the first current flow 115 in the first pole 110. As noted above in FIG. 2A, electrically conductive element 210 can include a surface having a portion electrically connected to, and extending from, the first pole 110. The method can also include the step of generating a magnetic field 217 from the second current flow 215 in the electrically conductive element 210, where the magnetic field 217 lowers a total/intrinsic reactance of the antenna 200. In some embodiments, the method can also include providing/conducting a third current flow 125 (e.g., from the power source 228) in the second pole 120 and generating a fourth current flow 225 in the electrically conductive component 220 from the third current flow 125. The method can also include generating a magnetic field 227 from the fourth current flow 225 in the electrically conductive component 220, where the magnetic field 227 lowers a total/intrinsic reactance of the antenna 200.

An inductive reactance is generated by the magnetic fields 217 and 227. The antenna 200 has an additional larger inductive reactance and, therefore, a smaller total reactance than a traditional dipole antenna (e.g., dipole antenna 100 of FIG. 1A). A reduction of the total reactance of the antenna 200 produces desirable performance enhancements, such as an increased bandwidth with respect to an equivalent traditional dipole configuration (e.g., a dipole antenna of FIG. 1A that does not have additional electrically conductive component/elements besides the poles 110 and 120).

The power gain of a matching circuit is proportional to the fourth degree of an antenna's reactance:

$$\text{Gain} \approx \frac{const}{B \cdot |\text{Im}(Z_A(f_C))|^4} \quad \text{EQN. 5}$$

where B is the bandwidth and $f_C$ is the band center frequency. Considering the dipole antenna 100 of FIG. 1A and the antenna 200 of FIG. 2A, and assuming the antennas 100 and 200 are equal in length, antenna 200 gives a power gain that exceeds the dipole antenna 100 power gain by 625-4096 times (28-36 dB). Equivalently, antenna 200 exhibits a matching bandwidth that is 625-4096 times higher compared to the dipole antenna 100 bandwidth at the equal power gain. The reason for the superior performance is the built-in inductive reactance ($X_L$) of antenna 200 caused by current flows 215 and 225 in the electrically conductive component/elements 210 and 220 and associated magnetic fields 217 and 227.

Figure 4:
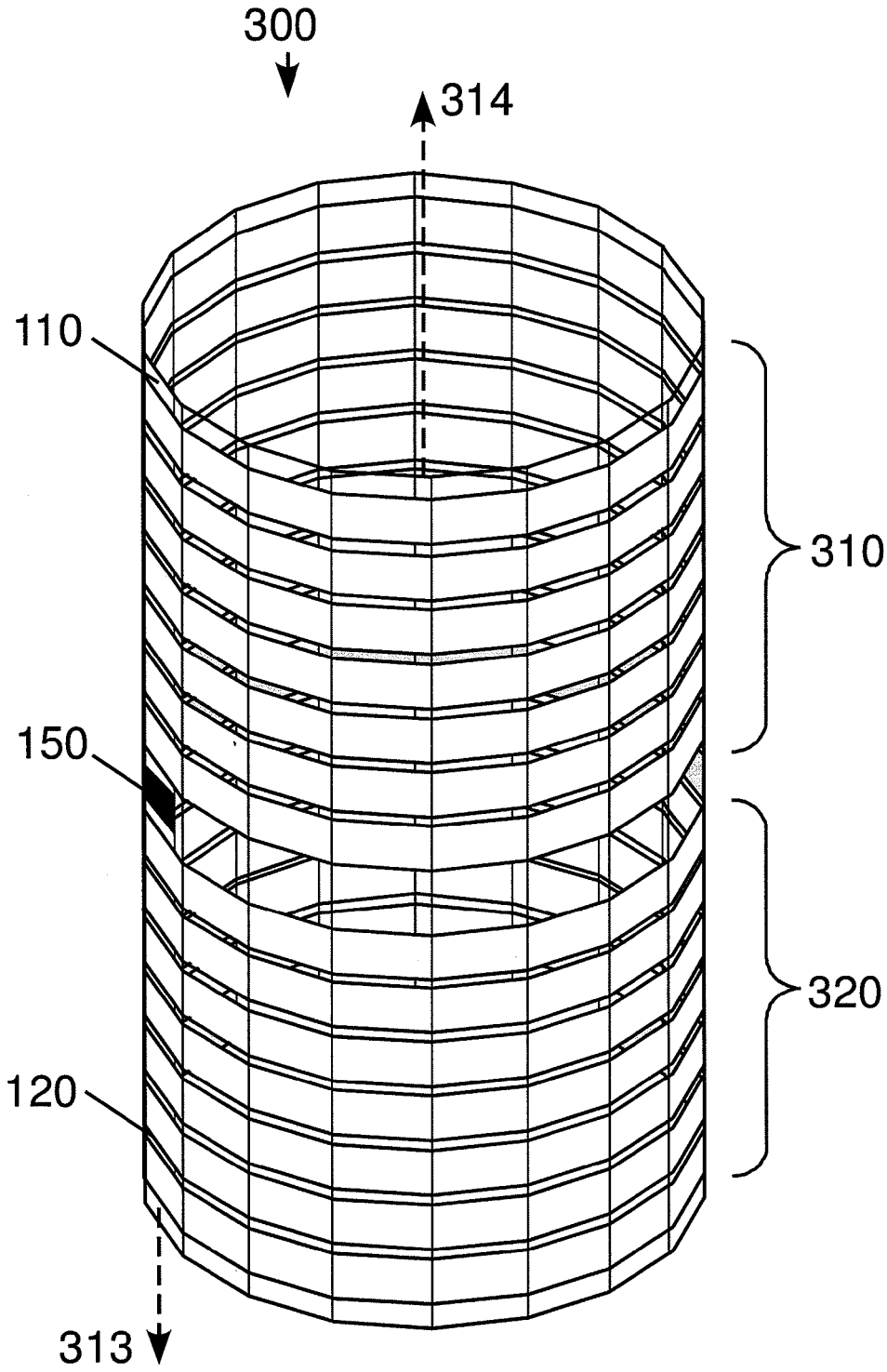
FIG. 4 is a schematic of a cylindrical volumetric antenna, according to another illustrative embodiment of the invention.

FIG. 4 shows a high performance compact volumetric antenna 300 (e.g., a "rib-dipole" antenna), according to an illustrative embodiment of the invention. The antenna 300 is a cylindrical volumetric antenna. The antenna 300 includes a first pole 110, second pole 120 and antenna feed 150. The antenna also includes sets of electrically conductive component/elements 310 and 320 (e.g., closed rings). In this embodiment, electrically conductive component/elements 310 and 320 are closed and curvilinear. Although not shown, there is a current flow in the closed set 310 of curvilinear electrically conductive component/elements and a current flow in the closed set 320 of curvilinear electrically conductive component/elements 310 and 320 and associated magnetic fields therefrom. Consequently, similar to the antenna 200 of FIGS. 2A-2B and 3, the antenna 300 has desirable additional inductive reactance due to the closed curvilinear electrically conductive component/elements. The antenna 300 can be "conformal" and conform to a body (e.g., aircraft wing, vehicle body, etc.)

A portion of the electrically conductive component/elements 310 and 320 are connected/attached (e.g., electrically connected) to the first pole 110 and second pole 120. Each of the respective electrically conductive component/elements 310 and 320 has a wall/surface. In some embodiments, the electrically conductive component/elements 310 and 320 do not encompass/surround the poles 110 and 120. Rather, a portion of the wall/surface is connected to poles 110 and 120, such that the electrically conductive component/elements 310 and 320 extend from poles 110 and 120. The electrically conductive component/elements 310 and 320 can extend laterally/outwardly from the sides of the poles 110 and 120 (e.g., like "ribs" along the poles 110 and 120). Electrically conductive component/elements 310 and 320 define a volume having a longitudinal axis 314, which can be substantially parallel to the longitudinal axis 313 shared by poles 110 and 120.

Figure 5A:
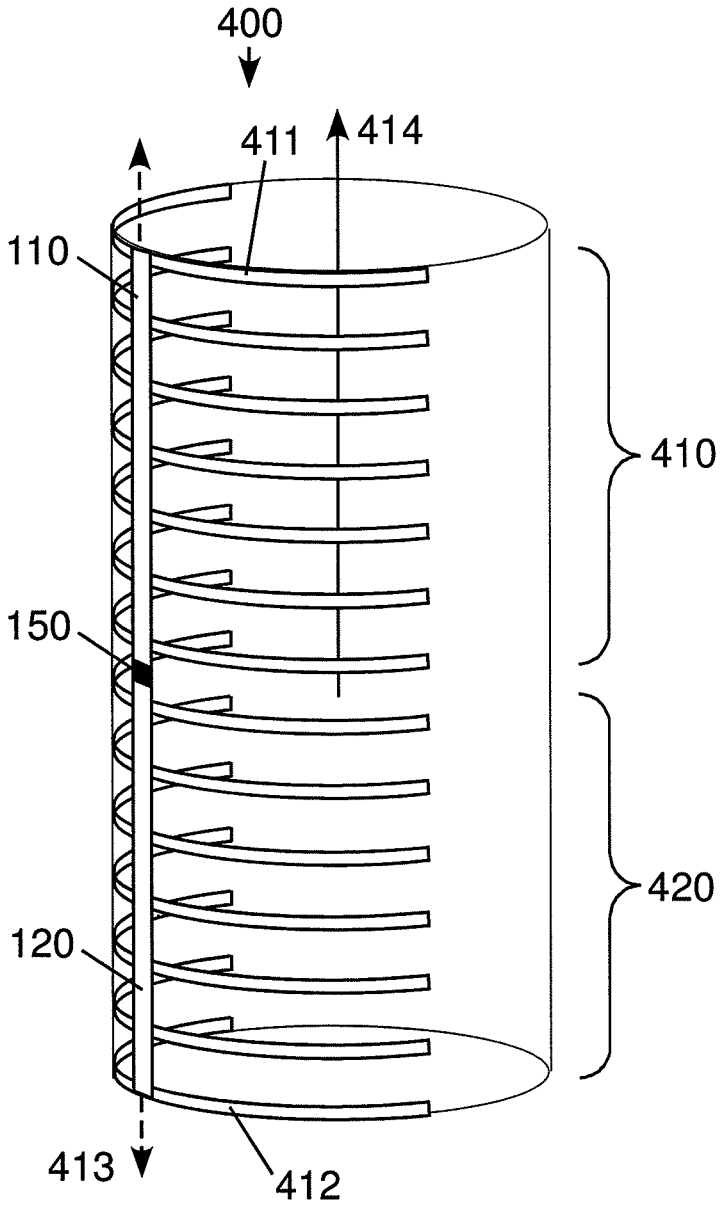
FIG. 5A a schematic of a half-cylinder volumetric antenna, according to yet another illustrative embodiment of the invention.

FIG. 5A shows a high performance compact volumetric antenna (e.g., a "rib-dipole"), according to another illustrative embodiment of the invention. The antenna 400 in FIG. 5 occupies a half-cylinder volume. The half-cylinder volumetric antenna 400 includes a first pole 110, a second pole 120 and antenna feed 150. The first pole 110 and second pole 120 can be coaxial. The half cylinder volumetric antenna 400 includes sets 410 and 420 of electrically conductive components/elements. In this embodiment, the curvilinear electrically conductive components/elements 410 and 420 are contoured and open (e.g., in contrast with curvilinear electrically conductive components/elements shown in FIGS. 2A-2B and 3) and in part, form the half-cylinder volume formed by antenna 400. The antenna 400 can be "conformal" and conform to a body (e.g., aircraft wing, vehicle body, etc.)

The electrically conductive component/elements 410 and 420 are connected to, and extend from, first pole 110 and second pole 120 (e.g., do not surround/encompass the dipole 110 and 120). In some embodiments, the electrically conductive component/elements 410 and 420 extend laterally from (e.g., extend outwards) from the poles 110 and 120 (e.g., like "ribs" attached to the poles 110 and 120). The electrically conductive component/elements 410 and 420 can be disposed along the first pole 110 and second pole 120. In this embodiment, the electrically conductive component/elements 410 and 420 are curved/curvilinear. The electrically conductive component/elements 410 and 420 include a contoured surface/wall 411 and 412. A portion of the contoured surface/wall 411 and 412 of each electrically conductive component/elements 410 and 420 is connected/attached (e.g., electrically connected) to the first pole 110 and the second pole 120. The half-cylindrical volume formed by the electrically conductive component/elements 410 and 420 can have a longitudinal axis 414 substantially parallel to the shared longitudinal axis 413 of the dipole 110 and 120.

Although not shown in FIG. 5A, there is a current flow in the first half-cylinder set 410 of curvilinear electrically conductive components/elements and a current flow in the second half-cylinder set 420 of electrically conductive components/elements and associated magnetic fields therefrom (e.g., as discussed in FIG. 3). The magnetic field associated with the electric current flow in curvilinear electrically conductive components/elements 410 and 420 electrically connected to a dipole (e.g., poles 110 or 120) or a monopole (e.g., as shown in FIG. 2B) occurs in both the case of open or closed ribs. Consequently, the half-cylinder volumetric antenna 400 with open electrically conductive components/elements also produces the increased inductive reactance (e.g., as described above and as in cylindrical volumetric antennas 300 and 200 of FIGS. 2A-2B and 3) even though the curvilinear electrically conductive components/elements from FIGS. 2A-2B and 3 were closed, not open.

Figure 5B:
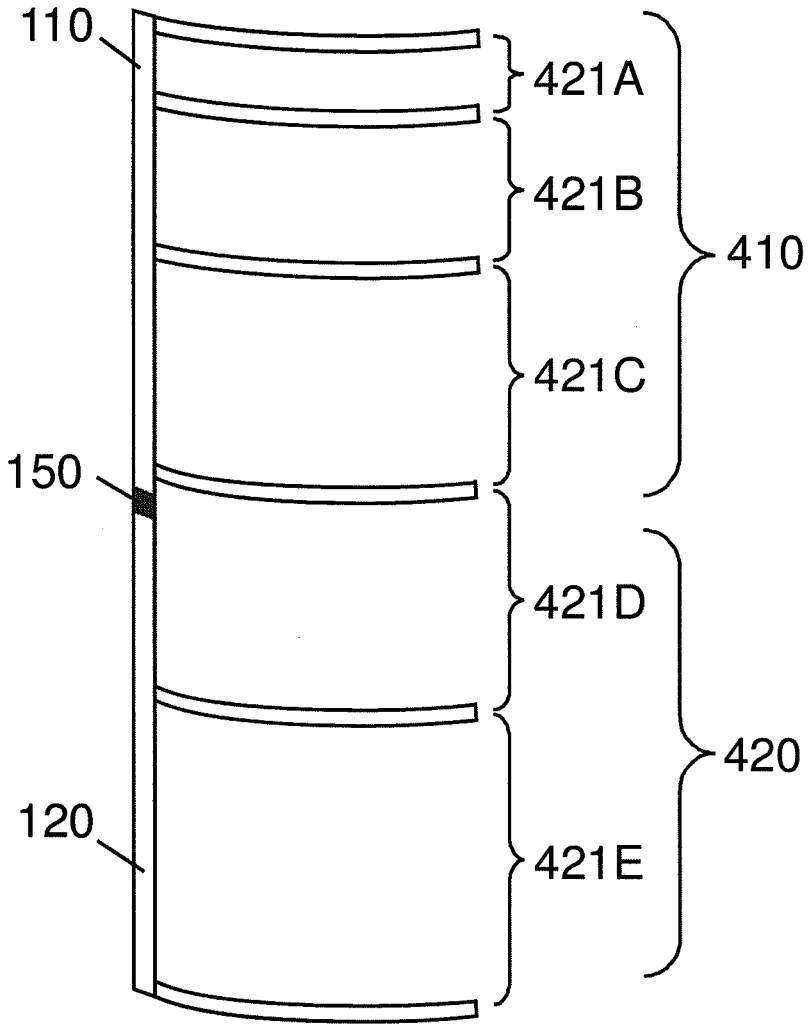
FIG. 5B is a schematic of a half-cylinder volumetric antenna, according to an illustrative embodiment of the invention.

FIG. 5B shows an antenna having electrically conductive component/elements 410 and 420 are spaced at varying distances 421A-E relative to one another. The electrically conductive component/elements 410 and 420 can be each spaced at a distance 421A-E relative to another electrically conductive component/element. In this embodiment, the distance is increasing from a first end of the antenna to the second end. However, the distance between the electrically conductive component/elements 310 and 320 can be, for example, constant (e.g., as shown in FIG. 5A), linear (e.g., linearly increasing/decreasing), logarithmic, randomly distributed, or any combination/variation thereof.

Figure 6B:
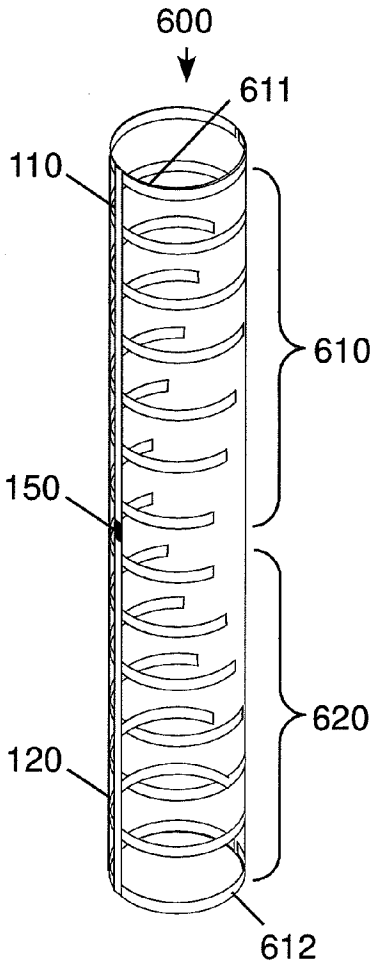
FIG. 6B is a schematic of an antenna with curvilinear electrically conductive elements of varying sizes, according to an illustrative embodiment of the invention.
Figure 6A:
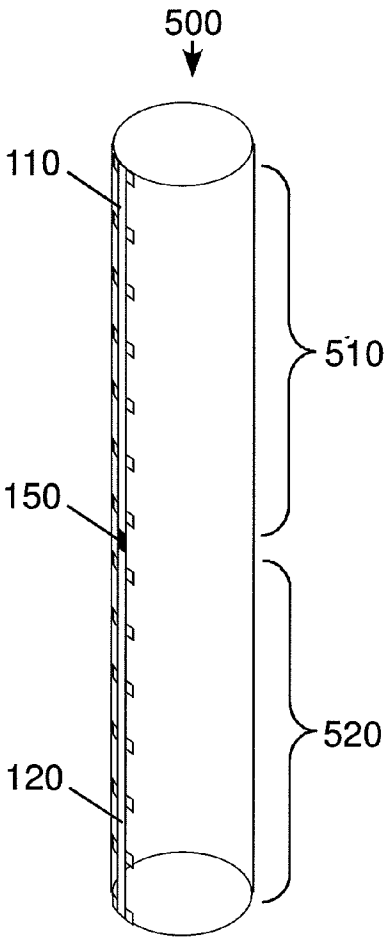
FIG. 6A is a schematic of an antenna with open and shortened curvilinear electrically conductive elements, according to an illustrative embodiment of the invention.

FIG. 6A is a schematic of a compact volumetric antenna (e.g., a "rib-dipole") that includes shortened and open curvilinear electrically conductive components/elements 510 and 520. The antenna 500 in FIG. 6A shows a first pole 110, second pole 120 and antenna feed 150. The antenna 500 also includes sets 510 or 520 of curvilinear electrically conductive components/elements that are shortened. The curvilinear electrically conductive components/elements 510 or 520 are "shortened" in that the curvilinear electrically conductive components/elements have a countered surface that has a length that is a fraction (e.g., 1/10) a closed cylinder perimeter.

When the length of the electrically conductive components/elements is too short, then the antenna will have a performance similar to a traditional dipole antenna (e.g., antenna 100 in FIG. 1A), due to the absence of the additional magnetic field. By way of example, when the ribs (e.g., electrically conductive component/elements) are less than 20-30% of the cylinder circumference the rib-dipole performs similar to the traditional dipole. When the ribs (e.g., electrically conductive component/elements) are 50% or longer, the performance is enhanced (e.g., as rib-dipole), due to the magnetic fields generated from the current conducted in the electrically conductive component/elements.

FIG. 6B shows an antenna 600 with curvilinear electrically conductive components/elements 610 and 620 that vary in size. The variable length antenna 600 includes a first pole 110, a second pole 120, and antenna feed 150. The antenna 600 can include electrically conductive component/elements 610 and 620. A portion of a surface/wall 611 and 612 of each of the electrically conductive component/elements 610 and 620 are attached/electrically connected to poles 110 and 120. The electrically conductive component/elements 610 and 620 are connected to, and extend from, poles 110 and 120. The curvilinear electrically conductive components/elements in sets 610 and 620 have a contour length (e.g., at least 50% the length of a closed cylinder circumference) so that the currents in the ribs produce the desired additional magnetic field, thereby providing enhanced performance of the antenna 600.

In this embodiment, the electrically conductive component/elements 610 and 620 are curvilinear, but they do not necessarily have to be (e.g., as shown in FIGS. 7 and 13). The curvilinear electrically conductive components/elements 610 and 620 are "shortened" (e.g., a contour length that is a fraction of a closed cylindrical perimeter), however, the contour lengths of the curvilinear electrically conductive components/elements 610 and 620 can vary. For example, the electrically conductive component/elements 610 and 620 can have different lengths, widths or thicknesses. The antenna 600 can include, for example, a variable length set of curvilinear electrically conductive components/elements 610 and 620.

FIG. 7 shows a non-curvilinear high performance compact volumetric antenna 700 ("rib-dipole antenna") according to an illustrative embodiment of the invention. This antenna 700 includes a "blade" dipole parallel to a ground plane. The blade dipole has a first blade 710 (e.g., a first pole made of a conductive plate such as a flat metal plate or sheet) and a second blade 720 (e.g., a second pole made of a conductive plate such as a flat metal plate or sheet), and a feed 750 between poles 710 and 720. The antenna 700 also can include planar electrically conductive sheets 715, 717, 725 and 727. The electrically conductive sheets 715, 717, 725 and 727 are capable of conducting a current that generates a magnetic field that lowers a total reactance of the antenna 700. In this embodiment, the antenna 700 is substantially parallel relative to a ground plane 730.

In this embodiment, the antenna 700 includes a first planar electrically conductive sheet 715 (e.g., a metal sheet or flat metal strip) and a second planar electrically conductive sheets 717 (e.g., a metal sheet or a flat metal strip) attached/connected (e.g., electrically connected) to the pole 710 and disposed at an angle (e.g., substantially perpendicular) relative to the metal ground plane 730 and pole 710. The electrically conductive sheets 715 and 717 extend from the pole 710.

The antenna 700 also includes a third planar electrically conductive sheet 725 (e.g., a metal sheet or flat metal strip) and a fourth planar electrically conductive sheet 727 attached to the pole 720 (e.g., a metal sheet or flat metal strip) and disposed at an angle (e.g., substantially perpendicular) relative to the metal ground plane 730 and pole 720. The electrically conductive sheets 725 and 727 can be attached to, and extend from, the pole 720.

Figure 1D:
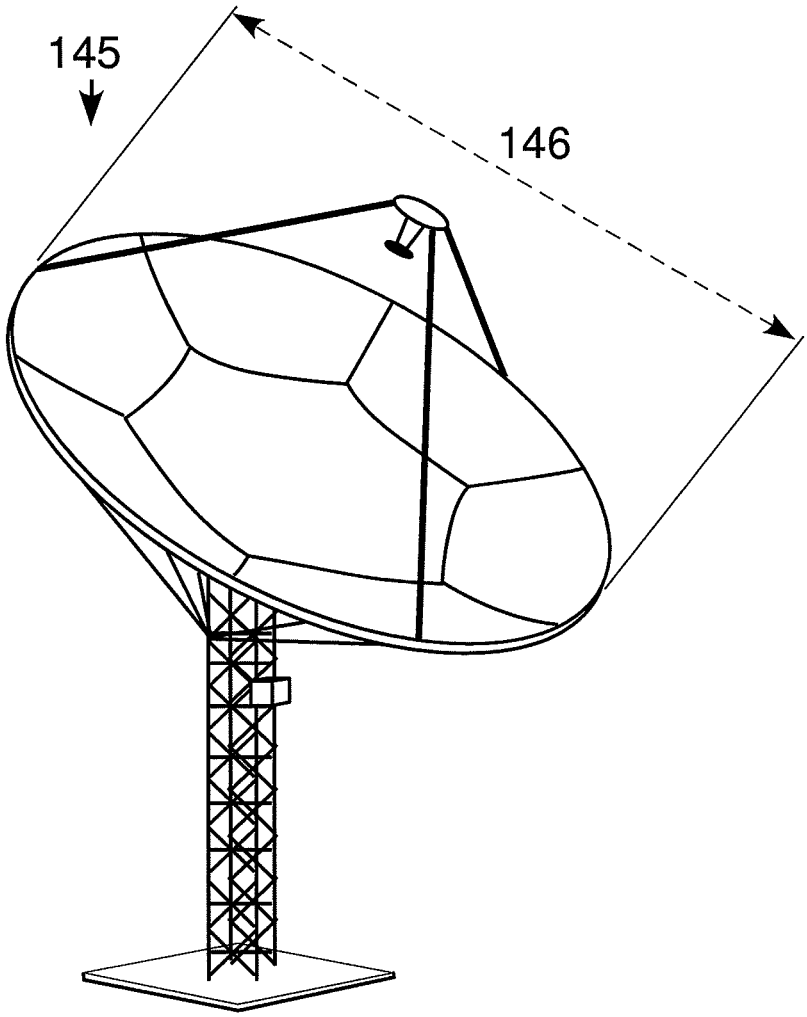
FIG. 1D PRIOR ART
FIG. 1D depicts a parabolic antenna in the prior art.

This antenna 700 configuration is very desirable for the low profile and wide bandwidth. It can be used as single element for a planar antenna array (e.g., as shown in FIG. 13) having a performance equivalent to a parabolic dish antenna (e.g., of FIG. 1D) but occupying a smaller volume. By way of example, a 2 m by 2 m array can be constructed using two or more antenna which can have a similar performance as that of a 3 m parabolic dish antenna (e.g., as shown in FIG. 1D).

The electrically conductive component/elements 715, 717, 725 and 727 extend from blades/poles 710 and 720. A portion of a surface of electrically conductive component/elements 715, 717, 725 and 727 are attached/connected (e.g., electrically connected) to poles 710 and 720. The electrically conductive component/elements 715, 717, 725 and 727, poles 710 and 720 and ground plane 730 can occupy a volume (e.g., a rectangular/square or parallelepiped). A longitudinal axis of the volume 713 can be substantially parallel to the longitudinal axis 714 shared by the poles 710 and 720 (e.g., along the y-axis).

Figure 8:
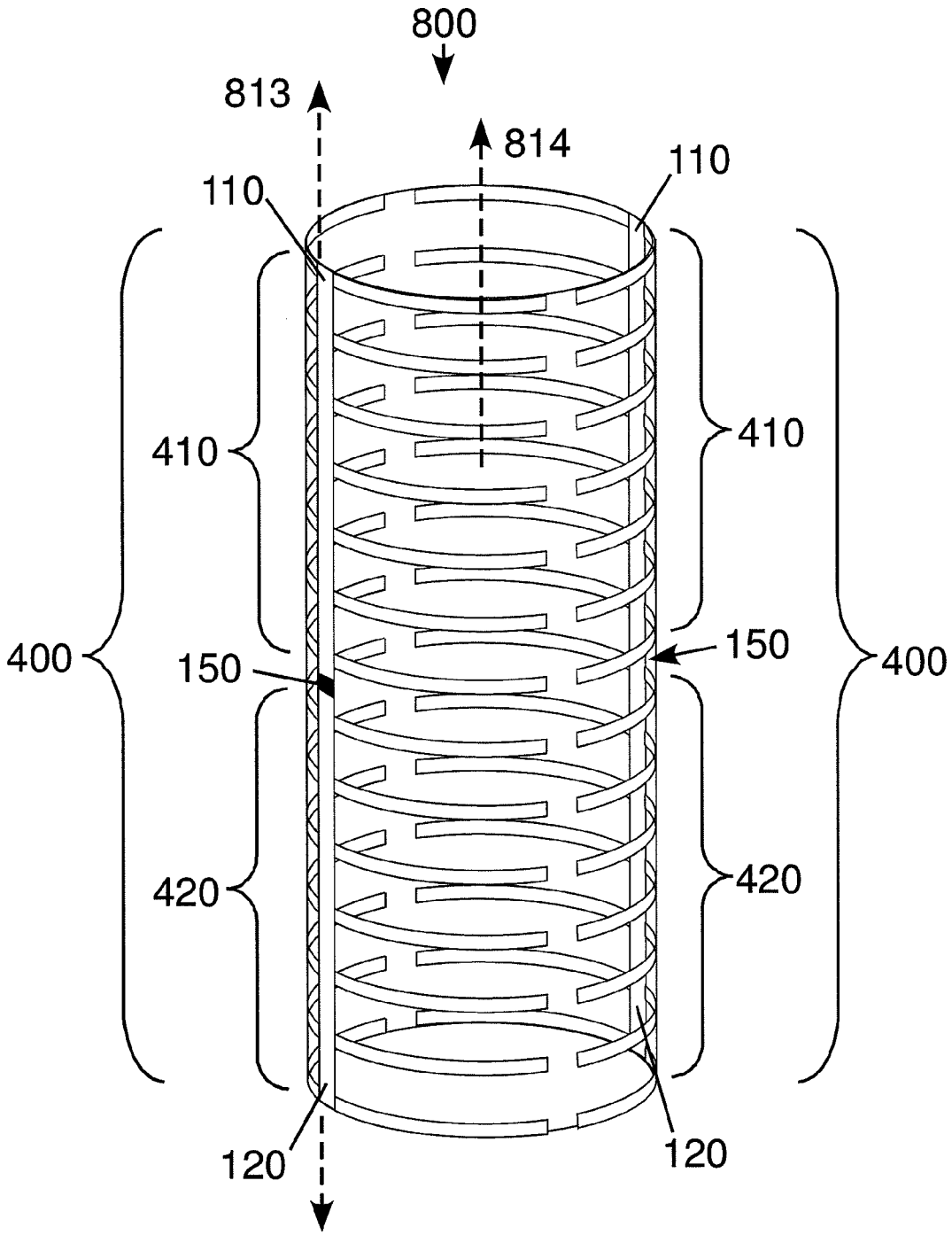
FIG. 8 is a schematic of a cylindrical volumetric antenna array, according to an illustrative embodiment of the invention.

FIG. 8 shows an antenna array 800 that includes dual half cylinder volumetric antennas 400 that occupy a cylindrical space, according to an illustrative embodiment of the invention. A half-cylinder volumetric antenna 400 can be disposed to face another half-cylinder multi-rib volumetric antenna 400. The antenna array 800 can include a first, second, third and fourth pole. For example, each half-cylinder volumetric antenna includes a first pole 110, a second pole 120 and an antenna feed 150. Each antenna 400 also includes several electrically conductive components/elements 410 and 420 that are attached/connected (e.g., electrically connected to) and extend from poles 110 and 120. The cylindrical volume can include a longitudinal axis 814 (e.g., the y-axis) substantially parallel to the longitudinal axis 813 shared by poles 110 and 120.

Figures 11A, 11B, 11C:
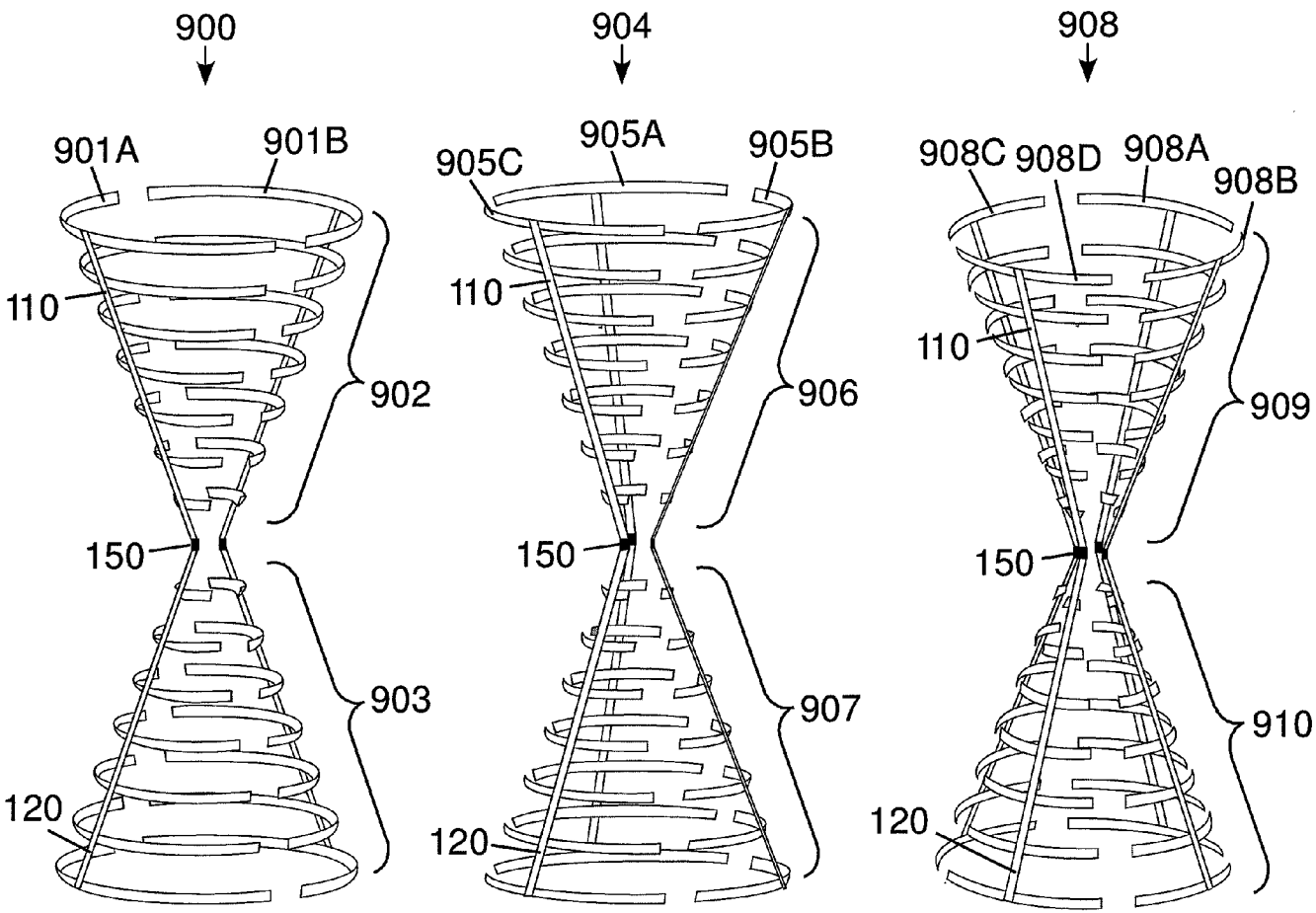
FIG. 11A is a schematic of a bi-conical volumetric antenna array, according to an illustrative embodiment of the invention.
FIG. 11B is a schematic of a bi-conical volumetric antenna array, according to another illustrative embodiment of the invention.
FIG. 11C is a schematic of a bi-conical volumetric antenna array, according to another illustrative embodiment of the invention.
Figure 12C:
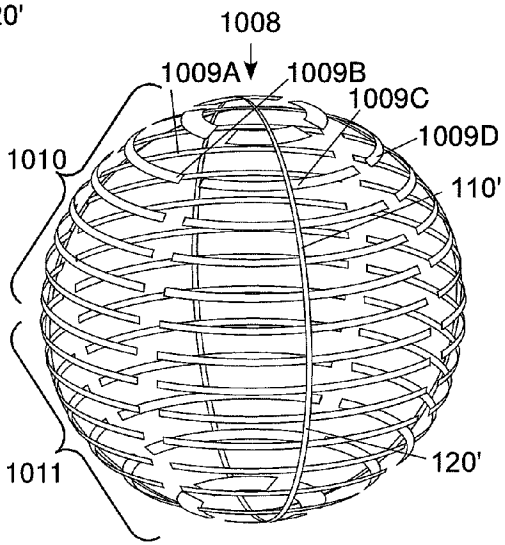
FIG. 12C is a schematic of a spherical volumetric antenna array, according to yet another illustrative embodiment of the invention.
Figure 12B:
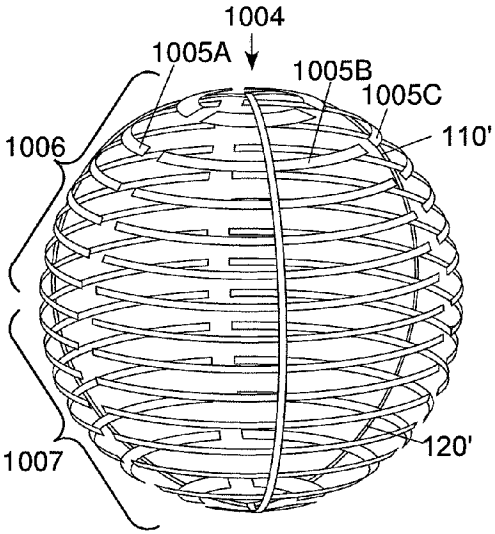
FIG. 12B is a schematic of a spherical volumetric antenna array, according to another illustrative embodiment of the invention.
Figure 12A:
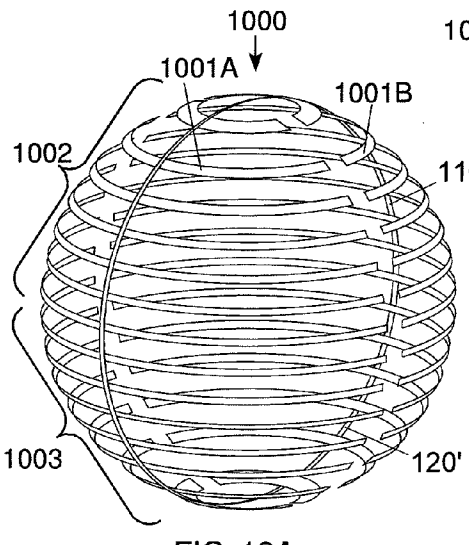
FIG. 12A is a schematic of a spherical volumetric antenna array, according to an illustrative embodiment of the invention.

The antenna (e.g., first, second, third, and fourth poles and the electrically conductive component/elements) occupies a volume. In this embodiment, the volume is a cylindrical volume (e.g., also shown in FIGS. 10A-C) and the length of the antenna (e.g., along the z-axis) is greater than a width, thickness or radial width (e.g., along the x-axis). However, in some embodiments, the antenna (e.g., poles, feed and electrically conductive component/elements) occupy a conical volume (e.g., such as the bottom or top half of the volume occupied by the antenna array shown in FIGS. 11A-11C), bi-conical volume (e.g., as shown in FIGS. 11A-11C), a spherical volume (e.g., as shown in FIGS. 12A-12C), a pyramid, or parallelepiped (e.g., as shown in FIG. 7).

Antenna 400 can be about 5 times shorter than a conventional HF whip antenna and can feature higher gain and pattern control due to, at least in part, the magnetic fields generated by the curvilinear electrically conductive components/elements 410 and 420. Antennas 400 can also be used for directed energy applications (e.g., 10 kW) while reducing overall antenna size as compared to, for example, parabolic antenna designs (e.g., as shown in FIG. 1D). In some embodiments, the half-cylinder volumetric antennas 400 are facing one another and are fed 180 degrees out of phase. The antenna 400 can be used for HF (e.g., 2 MHz to about 30 MHz). Antenna 400 can also have a height of about 65 cm and a diameter of about 10 cm. In some embodiments, each of the electrically conductive components/elements 410 and 420 have a length of about 17.5 cm, a width of about 1.2 cm and are spaced 4.5 cm relative to one another. The gain at 2 MHz can be about 4 dB and the gain at 16 MHz can be about 7 dB. In contrast, a conventional dipole (e.g., "whip") antenna has a height of about 3-5 m and has a gain at 2 MHz of about −10 dB and a gain at 16 MHz of about 3 dB.

Figure 9A:
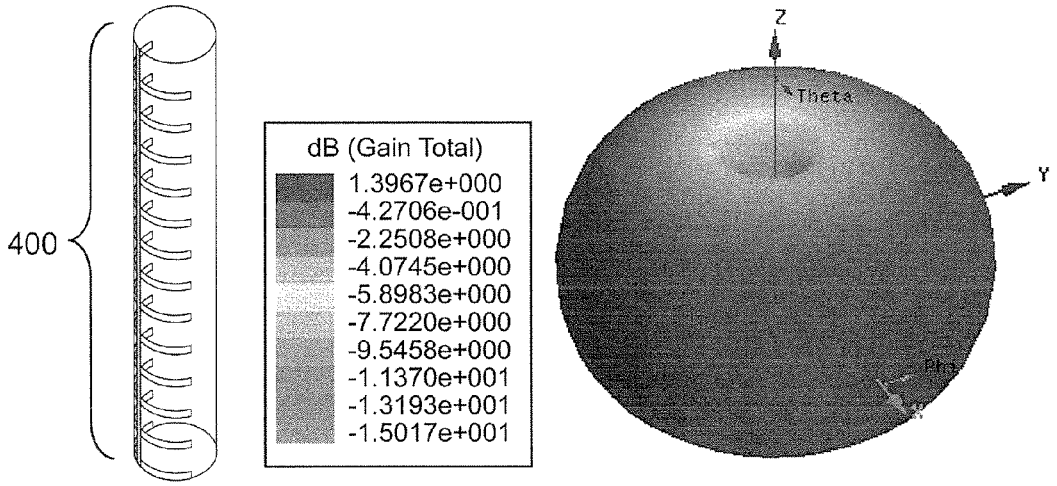
FIG. 9A shows an antenna pattern of a half-cylinder volumetric antenna, according to an illustrative embodiment of the invention.
Figure 9B:
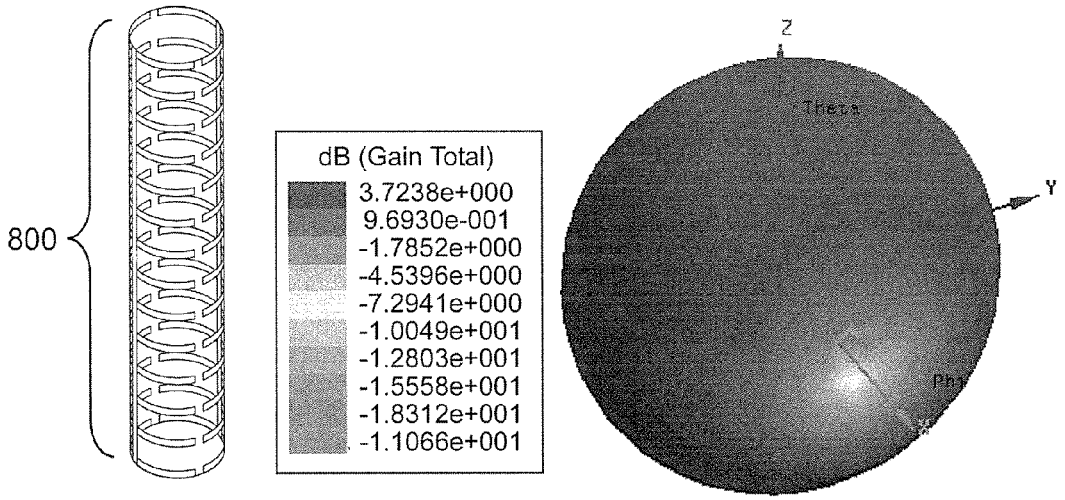
FIG. 9B shows an antenna pattern for a cylindrical volumetric antenna array, according to another illustrative embodiment of the invention.

FIG. 9A shows the antenna pattern for a half-cylinder volumetric antenna 400 (e.g., as shown in FIG. 5) and FIG. 9B shows an antenna pattern for an antenna array 800 including two half cylinder volumetric antennas (e.g., as shown in FIG. 8). The dual half-cylinder multi-rib volumetric antenna 800 has advantages compared to the half-cylinder multi-rib volumetric antenna 400 in terms of pattern control and higher gain. The antenna pattern of the half-cylinder multi-rib volumetric antenna 400 has the shape of a toroid with axis of rotation along the z-axis and is shown in FIG. 9A. The antenna pattern of an array of facing two half-cylinder multi-rib-volumetric antennas 800 is also a toroid, but with axis of rotation along the x-axis, as shown in FIG. 9B. This rotation of the antenna pattern (e.g., having an axis of rotation along the x-axis as shown in the Figure) can have advantageous applications, for instance in communications, for stealth and optimal placement on vehicles. The antenna array 800 can have better stealth, aerodynamic shape in land vehicles or safer cell operation for cell phone users.

Figures 10A, 10B, 10C:
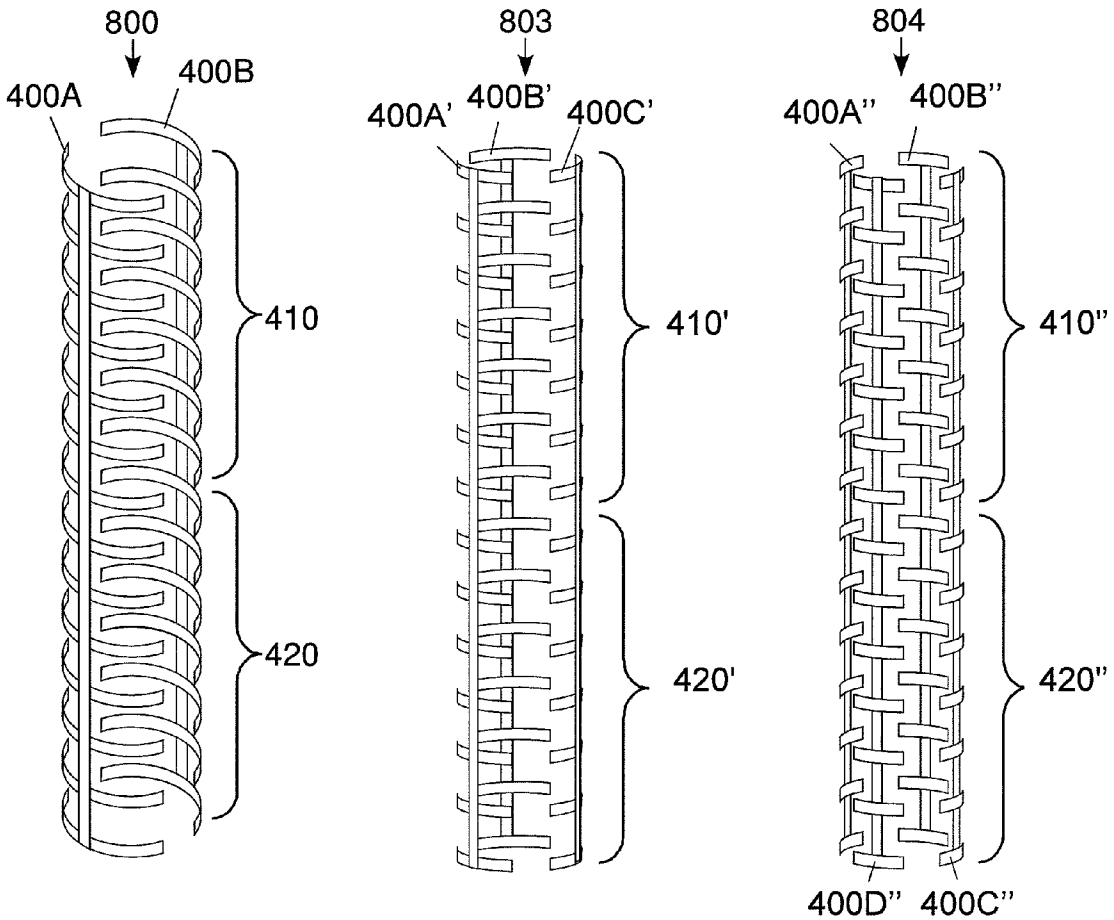
FIG. 10A is a schematic of a cylindrical volumetric antenna array, according to an illustrative embodiment of the invention.
FIG. 10B is a schematic of a cylindrical volumetric antenna array, according to another illustrative embodiment of the invention.
FIG. 10C is a schematic of a cylindrical volumetric antenna array, according to yet another illustrative embodiment of the invention.

FIG. 10A show different embodiments of cylindrical volumetric antennas, according to illustrative embodiments of the invention. A cylindrical volumetric antenna can include a single cylindrical volumetric antenna (e.g., as shown in FIG. 2) with closed curvilinear electrically conductive components/elements. As noted above in FIG. 2, a portion of a contoured surface of each of the electrically conductive component/elements is connected/attached (e.g., electrically connected) to the poles. The electrically conductive component/elements are connected to, and extend from, the poles. In some embodiments, the electrically conductive component/elements extend laterally from (e.g., extend from the sides of the poles). As shown in FIG. 10A, a cylindrical volumetric antenna 800 can also include two half cylinder volumetric antennas 400A and 400B disposed to face each other to occupy a cylindrical volume/space. Each half cylinder volumetric antenna 400 includes two poles and several curvilinear electrically conductive elements/components 410 and 420. A first half-cylinder volumetric antenna 400A can be fed 180° out of phase relative to a second half-cylinder volumetric antenna 400B.

Alternatively, as shown in FIGS. 10B and 10C, a cylindrical volumetric antenna 803 can include three or more volumetric antennas, each having shortened curvilinear electrically conductive components/elements. The electrically conductive component/elements are connected to, and extend from (e.g., laterally extend from), the poles. A portion of a contoured surface of each of the electrically conductive component/elements is connected to the poles. FIG. 10B shows a cylindrical volumetric antenna 803 that includes three "third-cylinder volumetric antennas" 400'A-C where each third-cylinder volumetric antenna 400'A, 400'B or 400'C includes two poles (e.g., poles 110 and 120 as shown in FIGS. 2A-2B, 3-5, and 6A-6B) and shortened curvilinear electrically conductive components/elements 410' and 420' (e.g., each having a contour length about ⅓ that of a closed cylindrical perimeter). The three third-cylinder volumetric antennas 400'A-C can be fed 120° out of phase with respect to one another.

FIG. 10C shows cylindrical volumetric antenna 804 that includes an array 804 of four "fourth cylinder volumetric antennas" 400"A-D where each fourth cylinder volumetric antennas have two dipoles and shortened curvilinear electrically conductive components/elements 410" and 420" (e.g., each having a contour length of about ¼ that of a closed cylindrical perimeter). The four volumetric antennas 400"A-D can be disposed to face one another so that the antenna array 804 occupies a cylindrical volume. The fourth cylinder volumetric antennas 400"A-D can be fed 90° out of phase with respect to one another.

FIGS. 11A-11C show bi-conical volumetric antennas, according to illustrative embodiments of the invention. The bi-conical volumetric antennas in FIGS. 11A-11C are arrays of two or more fractional bi-cone volumetric arrays that are oriented to occupy a bi-conical volume. For example, in FIG. 11A the antenna is an array 900 of two half-bi-cone volumetric antennas 901A and 901B, each including two poles 110 and 120, an antenna feed 150 and sets of curvilinear electrically conductive components/elements 902 and 903 disposed along the poles. The electrically conductive component/elements 902 and 903 are connected to/attached to (e.g., electrically connected), and extend from, the poles 110 and 120. The electrically conductive component/elements 902 and 903 can extend laterally from the poles 110 and 120. In this embodiment, the two half bi-cone volumetric antennas 901A and 901B are faced towards each other, so that the antenna 900 occupies a bi-conical volume. Each half-bi-conical volumetric antenna 901A and 901B can be fed 180° out of phase to one another.

FIG. 11B includes three third-bi-cone volumetric antennas 905A-C, each including two poles 110 and 120, an antenna feed 150 and curvilinear electrically conductive components/elements 906 and 907 disposed along each pole. As FIG. 11B shows third-bi-cones, the electrically conductive components/elements 906 and 907 are shorter than those in FIG. 11A. The three third-bi-cone volumetric antennas 905A-C can be faced towards one another, so that the antenna 904 occupies a bi-conical volume. Each third-bi-cone volumetric antenna 905A-C can be fed 120° out of phase to one another.

FIG. 11C includes four fourth-bi-cone volumetric antennas 908A-D, each including two poles 110 and 120 and curvilinear electrically conductive components/elements 909 and 910 disposed along each pole 110 and 120. The four volumetric antennas 908A-D are faced/disposed towards each other such that the antenna 908 occupies a bi-conical volume. Each fourth-bi-cone volumetric antenna 908A-D can be fed 90° out of phase to one another.

FIGS. 12A and 12B show spherical volumetric arrays, according to different illustrative embodiments of the invention. The spherical volumetric antenna array can include two or more fractional spherical volumetric antennas, disposed to face one another so that the antenna array occupies a spherical volume. For example, FIG. 12A shows two half-sphere volumetric antennas 1001A-B that are facing one another to occupy a spherical volume 1000. Each half-sphere volumetric antenna 1001A-B includes two curvilinear poles 110' and 120', an antenna feed (not shown for purposes of clarity) and curvilinear electrically conductive components/elements 1002 and 1003 disposed along the poles 110' and 120'. A portion of a surface/wall of each electrically conductive component/element 1002 and 1003 is connected to and extends from the poles 110' and 120'. In some embodiments, a portion of the electrically conductive component/elements 1002 and 1003 is attached/connected to (e.g., electrically connected to) the poles, but also laterally extend from the poles 110' and 120'. The curvilinear electrically conductive components/elements 1002 and 1003 of FIG. 12A have a contour length that is less than or equal to half of a perimeter for a closed cylinder and are of varying lengths so as to form the spherical volume. The half-sphere volumetric antennas 1001A-B can be fed 180° out of phase relative to one another.

FIG. 12B shows three third-sphere volumetric antennas 1005A-C that face one another to occupy a spherical volume 1004. Each third-sphere volumetric antenna 1005A-C includes two curvilinear poles 110' and 120' and curvilinear electrically conductive components/elements 1006 and 1007 disposed along the poles 110' and 120'. In this embodiment, the curvilinear electrically conductive components/elements 1006 and 1007 of FIG. 12B have a contour length that is less than or equal to a third of a perimeter for a closed cylinder and are of varying lengths so as to form the spherical volume. The third-sphere volumetric antennas 1005A-C can be fed 120° out of phase relative to one another.

FIG. 12C shows four fourth-sphere volumetric antennas 1009A-D that face one another to form an array 1008 that occupies a spherical volume. Each fourth sphere volumetric antenna 1009A-D includes two curvilinear poles 110' and 120' and curvilinear electrically conductive components/elements 1010 and 1011 disposed along each pole 110' and 120'. In this embodiment, the curvilinear electrically conductive components/elements 1010 and 1011 of FIG. 12C have a contour length that is less than or equal to a fourth of a perimeter for a closed cylinder and are of varying lengths so as to form the spherical volume. The fourth-sphere volumetric antennas 1009A-D can be fed 90° out of phase relative to one another.

FIG. 13 shows a further embodiment of an antenna array 1100 of non-curvilinear high performance compact volumetric antenna ("rib-dipole") elements 700. The antenna array 1100 includes a plurality (e.g., two or more) of antennas 700 each having poles (e.g., poles 710 and 720 as in FIG. 7) and planar electrically conductive component/elements (e.g., electrically conductive component/element 715, 717, 725 and 727 as in FIG. 7) that are connected to, and extend from, the poles. A portion of the electrically conductive component/elements are connected/attached to (e.g., electrically connected to) the poles. The electrically conductive component/elements also extend from the poles (e.g., extend from the sides like "ribs"). In this embodiment, each electrically conductive component/element is substantially perpendicular to each pole and ground plan 730. This antenna array 1100 has excellent performance for directed energy applications (e.g., focused narrow beam). The antenna array 1100 can have performance equivalent to the parabolic dish antenna 1D while occupying a smaller volume. By way of example, the array 1100 can be 2 m by 2 m and have a similar performance as that of a 3 m parabolic dish antenna (e.g., as shown in FIG. 1D).

The invention has been described in terms of particular embodiments. While the invention has been particularly shown and described with reference to specific illustrative embodiments, it should be understood that various changes in form and detail may be made without departing from the spirit and scope of the invention. The alternatives described herein are examples for illustration only and not to limit the alternatives in any way. The steps of the invention can be performed in a different order and still achieve desirable results.

The invention claimed is:

1. A wide-bandwidth antenna comprising:

a first pole formed by a first conductive member;

a second pole formed by a second conductive member;

a first antenna feed between the first conductive member and the second conductive member;

a third pole formed by a third conductive member;

a fourth pole formed by a fourth conductive member;

a second antenna feed between the third conductive member and the fourth conductive member;

at least one electrically conductive element including a surface having a portion that is electrically connected to, and extends from, at least one of the first conductive member, the second conductive member, the third conductive member or the fourth conductive member, the at least one electrically conductive element capable of conducting a current that generates a magnetic field that lowers a total reactance of the antenna, wherein when the first antenna feed and the second antenna feed are fed 180 degrees out of phase relative to one another, the antenna pattern of the wide bandwidth antenna is a toroid with an axis of rotation along an axis perpendicular to both a longitudinal axis and an axis defined by the first antenna feed and the second antenna feed;

wherein the first pole, the second pole, and the first antenna feed define a first half cylinder volume; the third pole, the fourth pole, and the second antenna feed define a second half cylinder volume; the first half cylinder volume and the second half cylinder volume sharing the longitudinal axis.

* * * * *

UNITED STATES PATENT AND TRADEMARK OFFICE

CERTIFICATE OF CORRECTION

PATENT NO. : 8,810,466 B2
APPLICATION NO. : 12/501973
DATED : August 19, 2014
INVENTOR(S) : Sciré-Scappuzzo et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1105 days.

Signed and Sealed this
Fifteenth Day of March, 2016

Michelle K. Lee

Michelle K. Lee
*Director of the United States Patent and Trademark Office*